US009107508B2

(12) United States Patent
Ishikawa et al.

(10) Patent No.: US 9,107,508 B2
(45) Date of Patent: Aug. 18, 2015

(54) CHAIR-TYPE MASSAGE APPARATUS

(75) Inventors: Tetsuya Ishikawa, Higashi-Osaka (JP); Shinsaku Shimizu, Higashi-Osaka (JP)

(73) Assignee: DAITO ELECTRIC MACHINE INDUSTRY COMPANY LIMITED, Osaka (JP)

( * ) Notice: Subject to any disclaimer, the term of this patent is extended or adjusted under 35 U.S.C. 154(b) by 16 days.

(21) Appl. No.: 13/882,209

(22) PCT Filed: Jun. 22, 2012

(86) PCT No.: PCT/JP2012/065941

§ 371 (c)(1),
(2), (4) Date: Apr. 29, 2013

(87) PCT Pub. No.: WO2013/145346

PCT Pub. Date: Oct. 3, 2013

(65) Prior Publication Data

US 2013/0341974 A1 Dec. 26, 2013

(30) Foreign Application Priority Data

Mar. 30, 2012 (JP) ..... P2012-080347

(51) Int. Cl.

| | |
|---|---|
| ***A47C 1/02*** | (2006.01) |
| ***A47C 7/62*** | (2006.01) |
| ***A47C 7/50*** | (2006.01) |
| ***A61H 7/00*** | (2006.01) |
| *A61H 23/02* | (2006.01) |
| *A61H 23/00* | (2006.01) |

(52) U.S. Cl.

CPC . *A47C 7/62* (2013.01); *A47C 7/506* (2013.01); *A61H 7/007* (2013.01); *A61H 23/006* (2013.01); *A61H 23/02* (2013.01); *A61H 2201/0149* (2013.01); *A61H 2201/0161* (2013.01); *A61H 2201/1215* (2013.01); *A61H 2201/164* (2013.01); *A61H 2201/1623* (2013.01); *A61H 2201/1654* (2013.01); *A61H 2201/1669* (2013.01); *A61H 2205/081* (2013.01); *A61H 2205/106* (2013.01)

(58) Field of Classification Search

CPC ..... A47C 1/0355; A47C 1/035; A47C 3/027
USPC ..... 297/84, 85, 86, 217.1; 601/98, 49
See application file for complete search history.

(56) References Cited

U.S. PATENT DOCUMENTS

| | | | | |
|---|---|---|---|---|
| 8,827,938 | B2 * | 9/2014 | Fukuyama | 601/99 |
| 2007/0273180 | A1 * | 11/2007 | Tanizawa et al. | 297/85 |

FOREIGN PATENT DOCUMENTS

| | | | |
|---|---|---|---|
| JP | 9-313563 | A | 12/1997 |
| JP | 11-076335 | A | 3/1999 |

(Continued)

*Primary Examiner* — Laurie Cranmer

(74) *Attorney, Agent, or Firm* — Birch, Stewart, Kolasch & Birch, LLP

(57) ABSTRACT

There is provided a chair-type massage apparatus which, while having a low-height backrest, affords an adequate massage effect without forcing a user to take an uncomfortable position. The chair-type massage apparatus 1 comprises: the seat 2; the base frame 8 for supporting the seat 2 on a floor; the backrest 3 disposed at the rear of the seat 2 for the support of user's back; and the massage section 6 incorporated in the backrest 3, for performing a massage on a user sitting on the seat 2, and further includes the up-and-down means 15 for switchably changing the height of the backrest 3 vertically within a range between the housing position where the lower part of the backrest 3 is stored under the seat 2 and the protruding position where the lower part of the backrest 3 is raised to an upper location.

7 Claims, 17 Drawing Sheets

(56) References Cited

FOREIGN PATENT DOCUMENTS

| | | | |
|---|---|---|---|
| JP | 11-342168 | A | 12/1999 |
| JP | 2001-61922 | A | 3/2001 |
| JP | 2011-250934 | A | 12/2011 |
| WO | WO 2009/040962 | A1 | 4/2009 |

* cited by examiner

CHAIR-TYPE MASSAGE APPARATUS

TECHNICAL FIELD

The present invention relates to a chair-type massage apparatus.

BACKGROUND ART

An example of massage apparatuses of chair type is disclosed in Patent Literature 1. The disclosed chair-type massage apparatus comprises a seat capable of the seating of a user, a backrest provided at the rear of the seat, and a massage mechanism disposed in the backrest for massaging the back of a user.

Among chair-type massage apparatuses, some are configured to have a low-height backrest, which are called "mini couch (armed couch)-type massage apparatuses". The chair-type massage apparatus disclosed in Patent Literature 1 is probably included in this type. Such a mini couch-type massage apparatus having a low-height backrest, while being preferred because of its appealing design as a trend, poses a certain problem due to the backrest which is lower in height than that of a common chair.

That is, even if it is desired to massage an upper part of the back, such as a shoulder, of a user by using such a mini couch-type massage apparatus, in some cases, an adequate massage cannot be performed because of the fact that a working part such as a kneading ball of the apparatus does not reach the shoulder height. The same problem may be encountered in the chair-type massage apparatus disclosed in Patent Literature 1.

In this regard, the chair-type massage apparatus disclosed in Patent Literature 1 is designed to be able to give a massage to, for example, user's shoulder by exploiting a system for moving the seat forward so that a user sitting on the seat can change his/her posture. More specifically, in the chair-type massage apparatus, as the seat is slidingly moved forward into a horizontal position, the buttocks of a user sitting on the seat are shifted forward correspondingly. In this way, with the backrest held in a fixed position, user's buttocks are moved forward, whereupon the user falls backward into a reclining position, and correspondingly the shoulder height is lowered. This makes it possible to give a shoulder massage to the user without the necessity of operating, for example, moving the backrest.

PRIOR ART REFERENCE

Patent Literature

Patent literature 1: Japanese Unexamined Patent Publication JP-A 2011-250934

SUMMARY OF THE INVENTION

Problems to be Solved by the Invention

In the chair-type massage apparatus disclosed in Patent Literature 1, the seat is configured for forward sliding movement. This allows a user to fall backward into a reclining position, thereby permitting a shoulder massage.

However, a user may feel unstableness when he/she takes a backward-tilted position, and such an uncomfortable position may become burdensome to the user. By reason of that, a mini couch-type massage apparatus such as presented in Patent literature 1 needs to be so designed that a user is able to have a massage in a stress-free comfortable position.

The present invention has been devised in view of the problem as mentioned supra, and accordingly an object of the present invention is to provide a chair-type massage apparatus which, while being designed to have a low-height backrest, is capable of providing an adequate massage effect without forcing a user to take an uncomfortable position.

Means for Solving the Problem

In order to achieve the above object, the following technical means is provided according to the present invention.

That is, a chair-type massage apparatus pursuant to the present invention comprises: a seat; a base frame for supporting the seat on a floor; a backrest disposed at the rear of the seat for the support of user's back; and a massage section incorporated in the backrest for performing a massage on a user sitting on the seat. In this construction, there is also provided up-and-down means for switchably changing the height of the backrest in a vertical direction within a range between a housing position where the lower part of the backrest is stored under the seat and a protruding position where the lower part of the backrest is raised to be located above the housing position.

It is preferable that the protruding position involves a first protruding position where the backrest is in an upwardly-extending state and a second protruding position where the backrest, while assuming the first protruding position, is tilted backward into a reclined condition, and that the up-and-down means is designed to move the backrest in the vertical direction between the housing position and the first protruding position, as well as to move the backrest in a front-rear direction between the first protruding position and the second protruding position.

It is preferable that the up-and-down means includes: an up-and-down link member which has its one end coupled to the base frame for free rocking motion about a right-left axis, and has its other end coupled to the lower end of the backrest; and a link driving section which is coupled at its basal end to the base frame, and has a mobile element formed at the front end thereof so as to be coupled to the midpoint of the up-and-down link member, for rocking the up-and-down link member about a right-left axis by moving the front end-side mobile element closer to and away from the basal end.

It is preferable that the up-and-down link member is built by joining a first member, which is coupled to the base frame for free rocking motion about a right-left axis, and a second member coupled to the backrest for free rocking motion about a right-left axis together in substantially L shape, and that the second member is so disposed that it becomes substantially parallel with the floor when the backrest is held in the housing position.

It is preferable that under the seat is stored a footrest for massaging the lower legs of a user, that between the footrest and the base frame is disposed a footrest rocking link member for coupling the footrest to the base frame for free rocking motion about a right-left axis, and that between the up-and-down link member and the footrest rocking link member is disposed a linking mechanism for rocking the footrest rocking link member in response to the rocking motion of the up-and-down link member.

It is preferable that the linking mechanism includes a rocking amount adjustment member for adjusting the amount of rocking motion of the up-and-down link member for moving the backrest so that it changes to the amount of rocking motion of the footrest rocking link member for moving the footrest, and whereafter transmitting that rocking amount.

It is preferable that the backrest has formed at its side surface a long guide slot extending along the direction of the length of the backrest, that the base frame is formed with a backrest support frame for supporting the backrest, and that the backrest support frame has formed at its front end a position-holding section which is slidably fitted in the guide slot of the backrest for holding the position of the backrest during its up-and-down movement.

It is preferable that an armrest is mounted on each of the right side and the left side of the seat, and that the upper end of the backrest is located at substantially the same level as the upper surface of the armrest when the backrest is held in the housing position.

Advantageous Effects of the Invention

According to the chair-type massage apparatus of the present invention, even if the chair-type massage apparatus is designed as a mini couch-type massage apparatus having a low-height backrest, it is possible to provide an adequate massage effect without forcing a user to take an uncomfortable position.

MODES FOR CARRYING OUT THE INVENTION

Hereinafter, a chair-type massage apparatus 1 in accordance with the first embodiment of the present invention will be described with reference to the drawings.

First Embodiment

Figure 1A:
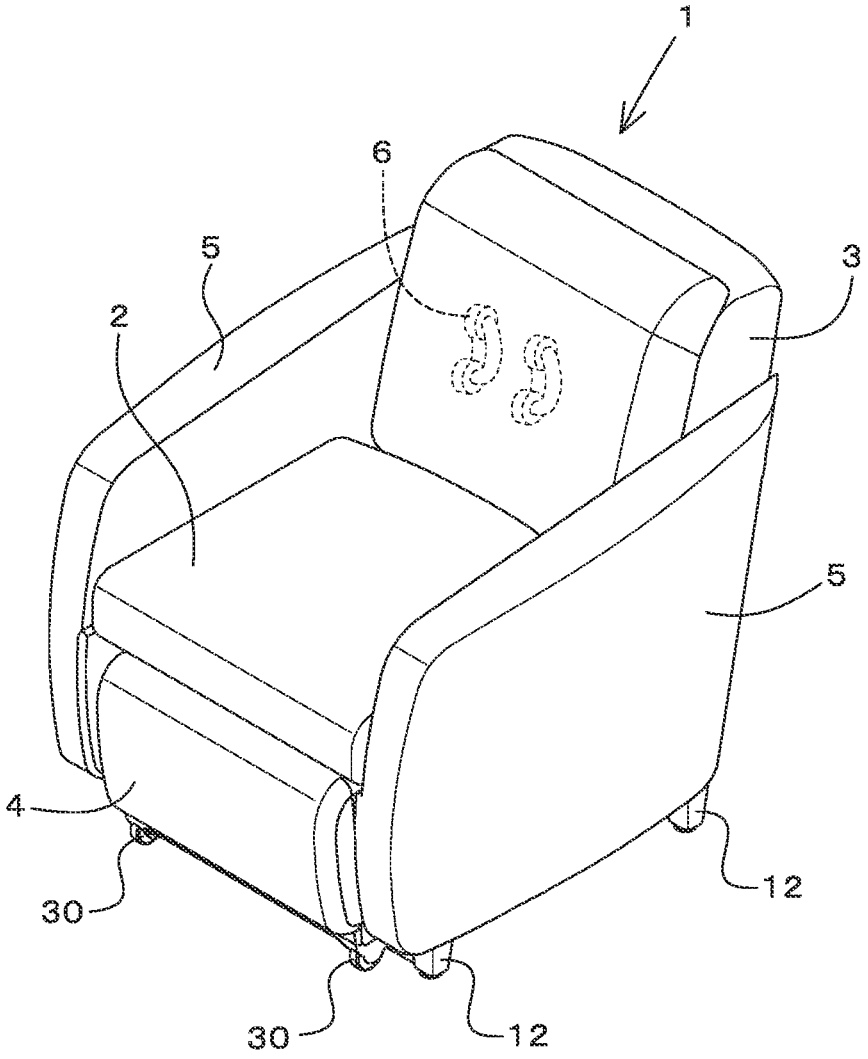
FIG. 1A is a perspective view of a chair-type massage apparatus, with its backrest held in a housing position.

FIGS. 1A through 8 show the chair-type massage apparatus 1 of the first embodiment. Specifically, FIGS. 1A and 1B are perspective view showing the appearance of the chair-type massage apparatus 1, FIGS. 2A to 2C are side views showing the same, and FIGS. 3 to 8 are views showing the internal structure of the chair-type massage apparatus 1. Note that there may be cases where part of the construction is omitted in the drawings for convenience in explanation.

Moreover, in the following description, the direction of from right to left (left to right) as viewed in FIGS. 6 to 8 will be referred to as the front-rear direction for explaining the chair-type massage apparatus 1, and the direction of from top to bottom (bottom to top) as viewed in FIGS. 6 to 8 will be referred to as the vertical direction for explaining the chair-type massage apparatus 1. Moreover, the direction of drilling through the paper sheet with each of FIGS. 6 to 8 printed on it will be referred to as the right-left direction or widthwise direction for explaining the chair-type massage apparatus 1. The above definitions of directions are based on the sight of a user sitting on the chair-type massage apparatus 1.

Firstly, as shown in FIG. 1A, the chair-type massage apparatus 1 comprises a seat 2 and a backrest 3 mounted at the rear of the seat 2. Moreover, a footrest 4 capable of massaging the lower legs of a user is set under the seat 2, and an armrest 5 is mounted on each of the right side and the left side of the seat 2 for the resting of the forearm of a user sitting on the seat 2.

Figure 1B:
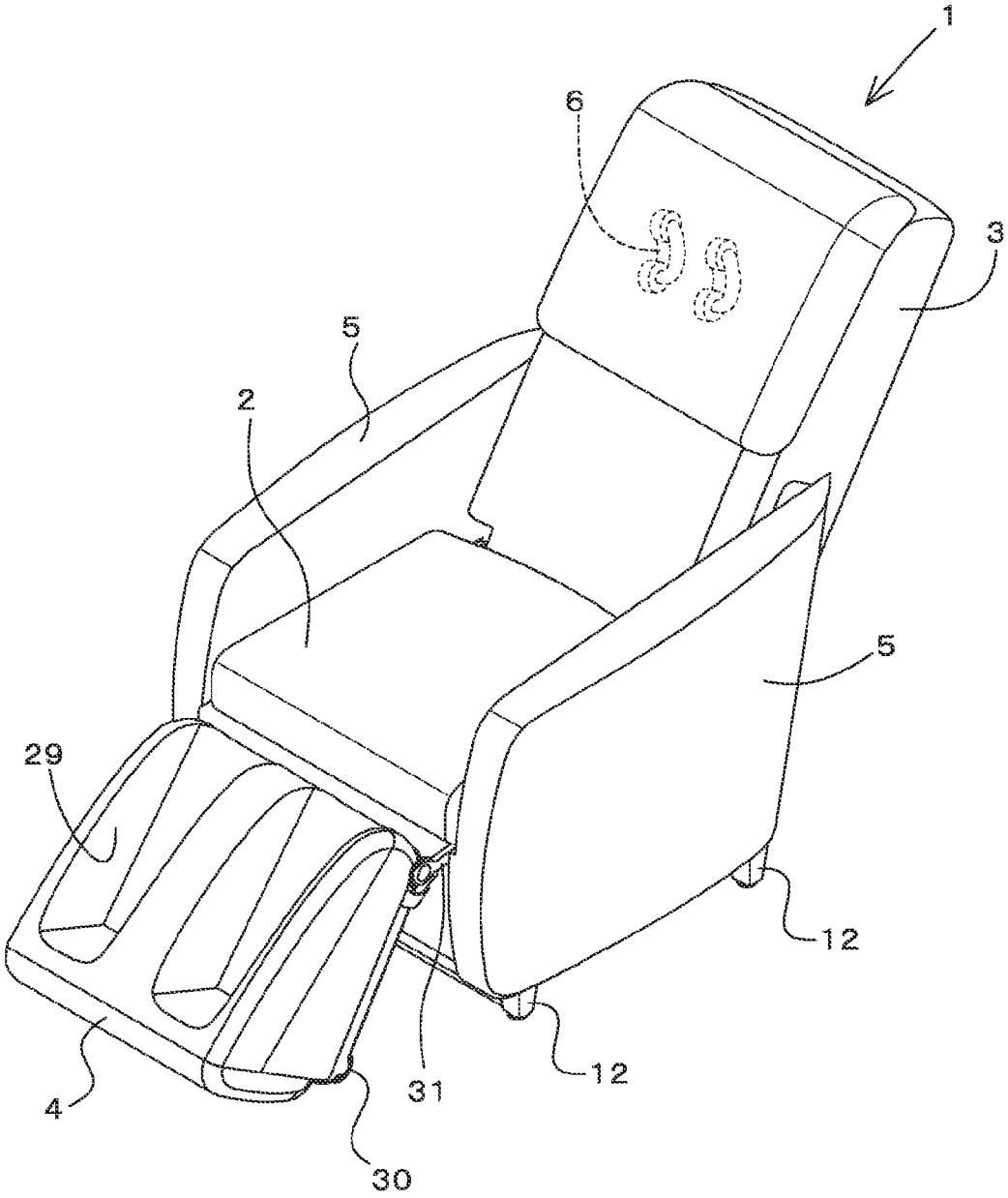
FIG. 1B is a perspective view of the chair-type massage apparatus, with the backrest protruded (in a second protruding position).
Figure 2A:
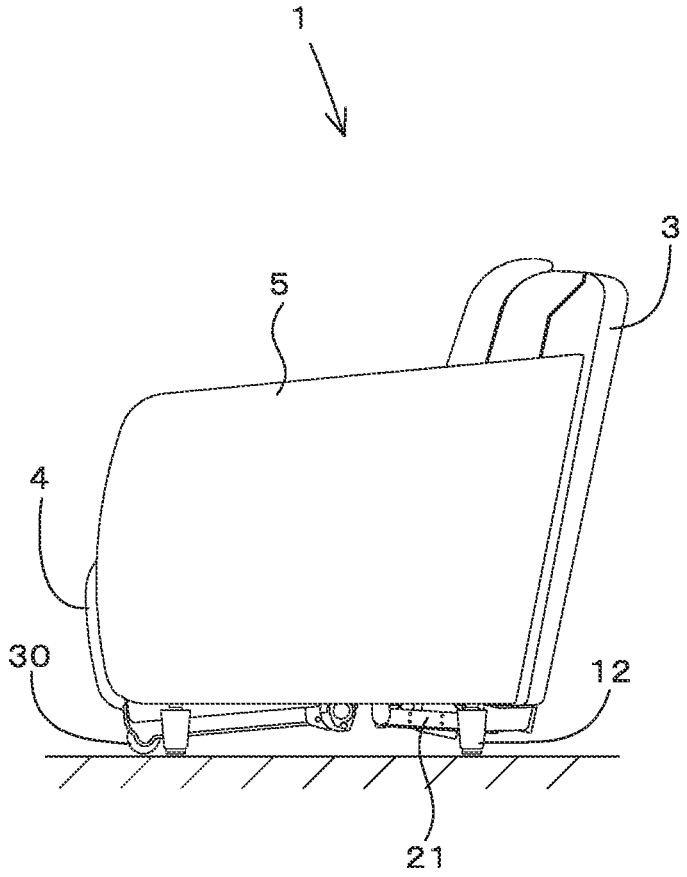
FIG. 2A is a side view of the chair-type massage apparatus, with the backrest held in the housing position.
Figure 2B:
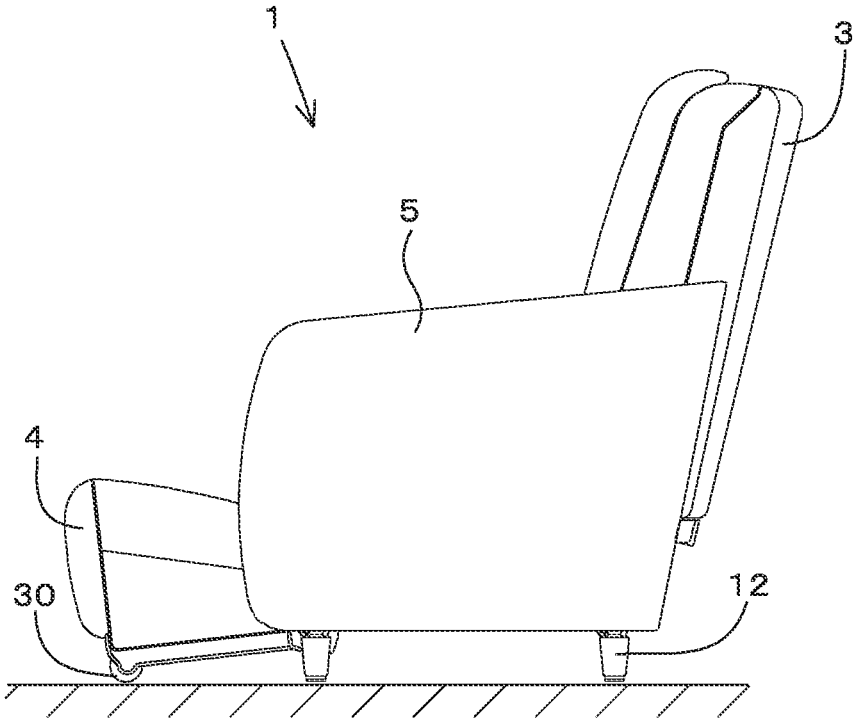
FIG. 2B is a side view of the chair-type massage apparatus, with the backrest assuming a first protruding position.
Figure 2C:
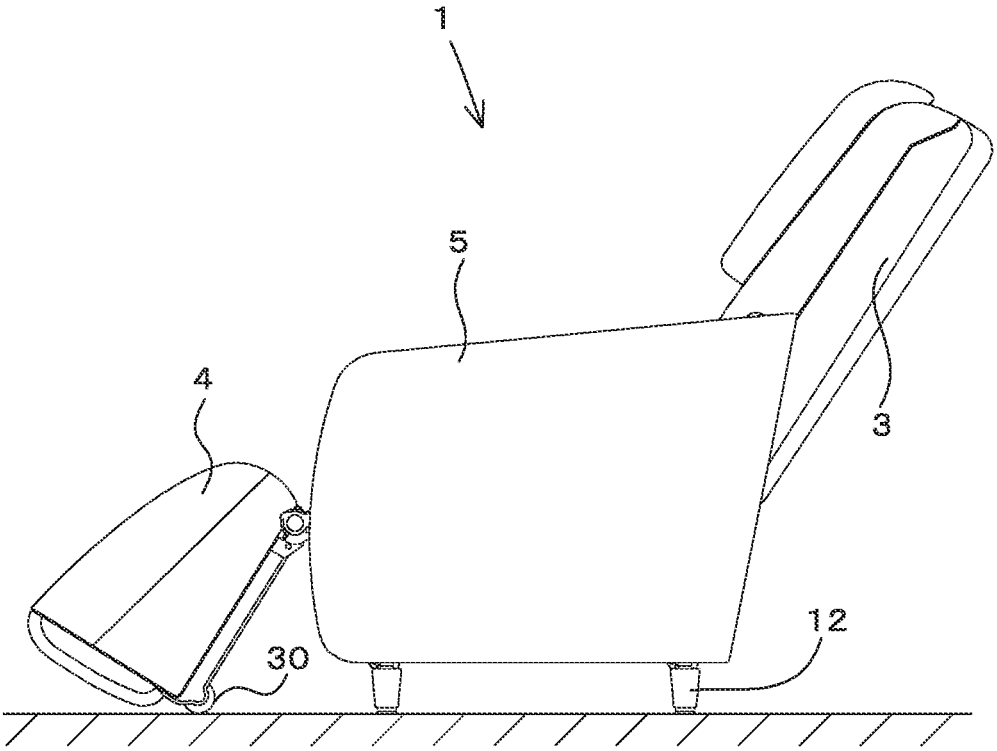
FIG. 2C is a side view of the chair-type massage apparatus, with the backrest assuming the second protruding position.

Looking at a transition from the state shown in FIG. 1A to the state shown in FIG. 1B, and a transition from the state shown in FIG. 2A to the state shown in FIG. 2B and from there to the state shown in FIG. 2C, it will be seen that the above-described backrest 3 is configured to move greatly upward from a housing position, where the lower part of the backrest 3 is stored under the seat 2, toward a first protruding position located above the housing position (where the backrest 3 is extended upward), and then move greatly backward toward a second protruding position located behind the first protruding position (where the backrest 3 is tilted backward into a reclined condition). As indicated by broken lines, the backrest 3 has a built-in massage section 6 for massaging the back and waist of a user.

Moreover, the footrest 4 is also configured to move forward from the location under the seat 2 (housing position) to a protruding position (working position) in response to the upward movement (rising movement) of the backrest 3. Although not shown in the figure, the footrest 4 has a built-in foot massage section for massaging the lower legs of a user.

Next, the seat 2, the backrest 3, the footrest 4, and the armrest 5 constituting the chair-type massage apparatus 1 of the first embodiment will be described in detail.

Figure 3:
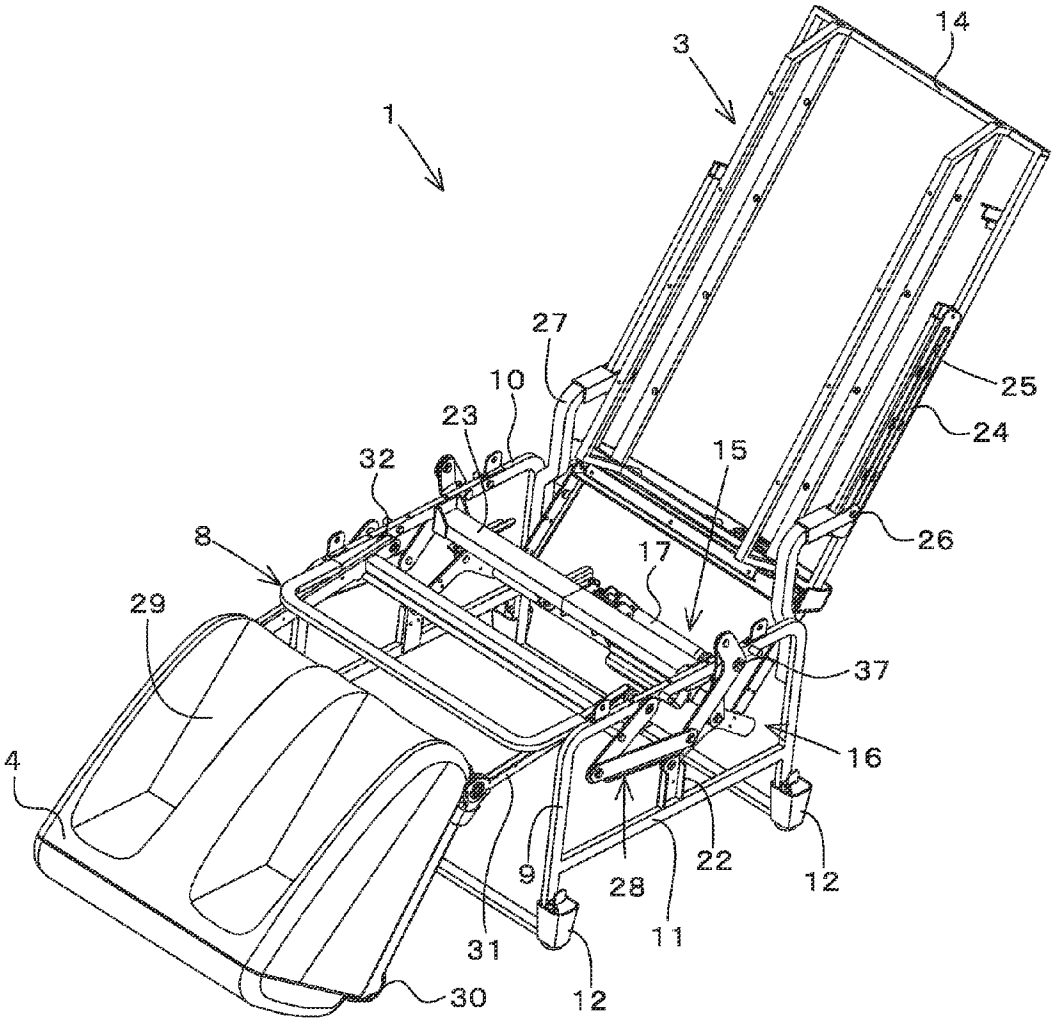
FIG. 3 is a front perspective view showing the internal structure of the chair-type massage apparatus (First embodiment).

The seat 2, which is a rectangular member having an area large enough to support the buttocks of a sitting user from below, is made of a cushion material. As shown in FIG. 3, under the seat 2 is disposed a base frame 8 whereby the seat 2 is supported at a position spaced above a floor.

Figure 4:
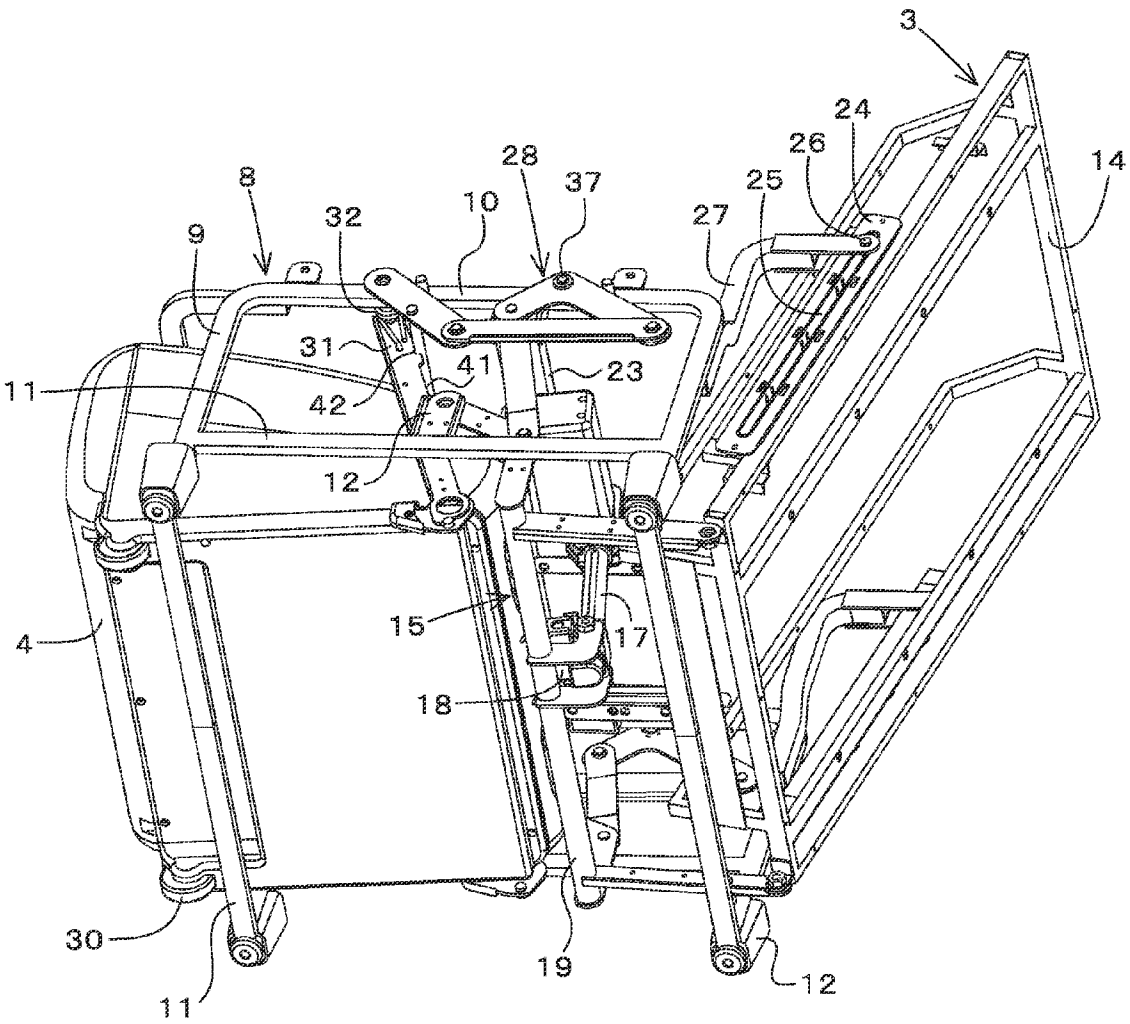
FIG. 4 is a rear-bottom perspective view showing the internal structure of the chair-type massage apparatus (First embodiment).
Figure 5:
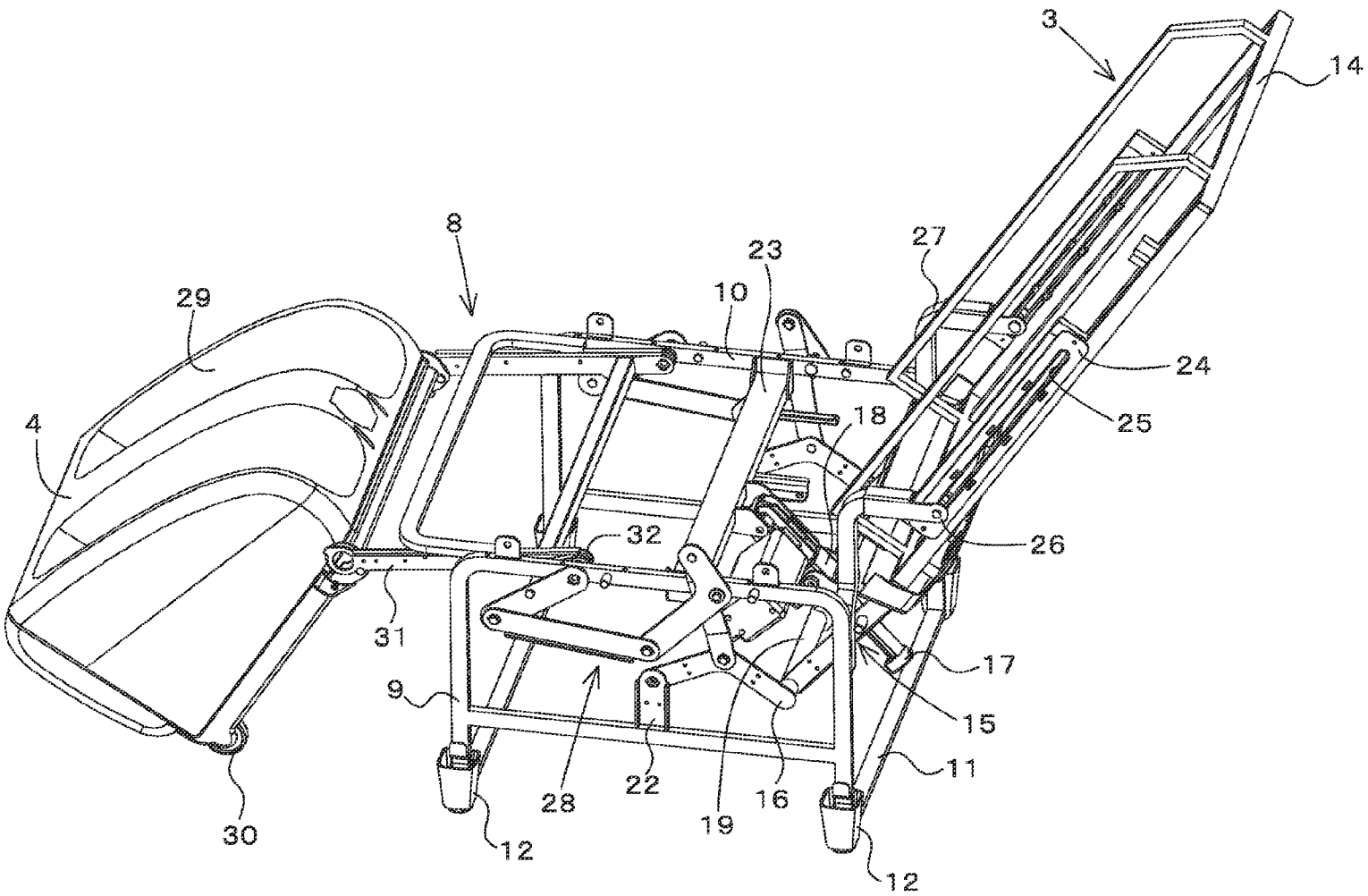
FIG. 5 is a rear perspective view showing the internal structure of the chair-type massage apparatus (First embodiment).

As shown in FIGS. 3 to 5, the base frame 8 is built in the form of a framework by combining a plurality of metal pipe members, angle bars, and the like together. The base frame 8, which acts as support for bearing the full weight of the chair-type massage apparatus 1 on the floor, is capable of not only supporting the seat 2 as above described, but also bearing the weights of the footrest 4 and the backrest 3 and the weight of a user sitting on the seat 2 as well.

The base frame 8 comprises: four column support frames 9 extending in the vertical direction in upstanding condition, the lower ends of which are grounded on the floor; a horizontally running upper frame 10 mounted for fixed connection between the upper ends of the column support frames 9; and a horizontally running lower frame 11 mounted below the upper frame 10 for fixed connection between the lower ends of the column support frames 9.

The column support frames 9 are located at the four corners of the seat 2, respectively. In other words, one column support frame 9 is disposed in a location corresponding to each of the left front corner, the right front corner, the left rear corner, and the right rear corner of the seat 2, viz., there are four column support frames 9 in all. The upper frame 10 is a cross-member which runs horizontally across the column support frames 9 arranged side by side, or arranged adjacent each other in the front-rear direction, for providing connection between the upper ends of the adjacent column support frames 9. The above-described seat 2 is placed on the upper frame 10. Like the upper frame 10, the lower frame 11 is also a cross-member which runs horizontally across the column support frames 9 arranged side by side, or arranged adjacent each other in the front-rear direction, for providing connection between the lower ends of the adjacent column support frames 9. Note that the column support frame 9 has formed at its lower end a non-slip member 12 capable of preventing slippage of the massage apparatus on the floor.

As described just above, the column support frames 9 are spaced apart in the front-rear direction and the right-left direction; the upper frames 10, as well as the lower frames 11, are spaced apart in the right-left direction; and the upper frame 10 and the lower frame 11 are spaced apart in the vertical direction. That is, these frames are so arranged as to secure enough space for the placement of structural components. The space thusly created inside the base frame 8 is utilized for the storage of the footrest 4.

There is provided a pair of right-hand and left-hand armrests 5 that are situated on the right side and the left side, respectively, of the above-described seat 2, for the resting of the forearm of a sitting user. The armrest 5 is a board-like member disposed in upstanding condition, with its board surface facing sideward (rightward or leftward). The upper end face of the armrest 5 is substantially flat-shaped for easiness in the resting of the forearm of a user. The armrest 5 may be configured to have, at its surface facing inward in the widthwise direction, a massage section for giving a massage such as a kneading massage, a tapping massage, or a vibratory massage to the waist, thighs, or other body part of a user sitting on the seat 2.

The backrest 3 is a member which has a substantially rectangular shape when viewed from the front, the area of which is large enough to support user's back. In the illustrated example, the width of the backrest 3 in the right-left direction is substantially the same as that of the seat 2. Moreover, the backrest 3 is made with an increased thickness to bear the weight of the upper half of user's body.

Inside the backrest 3, there are provided a backrest frame 14 built by combining metal pipe members or the like together, for bearing, as is the case with the seat 2, the weight of a user leaning at his/her back on the backrest; a cushion material supported by the backrest frame 14; and a massage section 6 for giving a massage such as a kneading massage, a tapping massage, or a vibratory massage to the body of a user sitting on the seat 2 between the back and waist regions.

In the chair-type massage apparatus 1 of the first embodiment, as shown in FIG. 1A, when it is not operated to give a massage to the back of a user (when the backrest 3 assumes the housing position), the upper end of the backrest 3 is located at substantially the same level as the upper surface of the armrest 5. That is, from outer appearance, the chair-type massage apparatus 1 of the first embodiment, being designed so that the upper end of the backrest 3 is located at exactly the same level as the upper surface of the armrest 5 or located slightly above the level of the upper surface of the armrest 5, is a certain type of chair falling under categories including e.g., stylish sofas and legless chairs. In this specification, a chair having such an appearance will be referred to as "mini couch-type chair". The chair-type massage apparatus 1 of the first embodiment can thus be considered as a mini couch-type massage apparatus.

However, even if it is desired to massage user's back, in particular, user's shoulder by using such a mini couch-type massage apparatus, in some cases, a shoulder massage cannot be performed because of the fact that the massage section does not reach the shoulder height. In order to avoid such an inconvenience, in the chair-type massage apparatus 1 of the first embodiment, the backrest 3 is mounted for up-and-down movement in the vertical direction.

More specifically, the chair-type massage apparatus 1 of the first embodiment is characterized by having up-and-down means 15 for switchably changing the height of the backrest 3 in the vertical direction within a range between a housing position (refer to FIG. 6) where the lower part of the backrest 3 is stored under the seat 2 and a protruding position where the lower part of the backrest 3 is raised to be located above the housing position. The protruding position involves a first protruding position (refer to FIG. 7) where the backrest 3 is in an upwardly-extending state and a second protruding position (refer to FIG. 8) where the backrest 3, while assuming the first protruding position (upwardly-extending state), is tilted backward into a reclined condition.

Even in a mini couch-type massage apparatus, by providing such an up-and-down means 15, it is possible to cause the backrest 3 to protrude when it is desired to massage user's back, and thereby allow a user to have a fully effective massage in a stress-free comfortable position.

Next, the up-and-down means 15 provided in the chair-type massage apparatus 1 of the first embodiment will be described.

As shown in FIGS. 3 to 5, the up-and-down means 15 comprises an up-and-down link member 16 for moving the backrest 3 up and down relative to the above-described base frame 8, as well as causing the backrest 3 to rock about a right-left axis; and a link driving section 17 constructed of a linear actuator. The link driving section 17 is coupled to the up-and-down link member 16, so that the up-and-down link member 16 can be rocked by telescopic driving operation of the driving section 17.

More specifically, the up-and-down link member 16 has its one end coupled to the base frame 8 for free rocking motion about the right-left axis, and has its other end coupled to the lower end of the backrest 3. The link driving section 17 is coupled at its basal end to the base frame 8 for free rotation about the right-left axis. Moreover, in the link driving section 17, a mobile element 18 formed at the front end thereof is coupled to the midpoint of the up-and-down link member 16. As the front end-side mobile element 18 is moved closer to and away from the basal end, the up-and-down link member 16 is rocked about the right-left axis.

It is noted that the up-and-down link member 16 and each of link components connected to the up-and-down link member 16 are arranged on each of the right side and the left side of the seat 2 in symmetrical relation to each other, and the right-hand up-and-down link member 16 with link components and the left-hand up-and-down link member 16 with link components are coupled to each other in the widthwise direction by means of a coupling rod 19 which will hereafter be described or otherwise. Accordingly, the up-and-down link member 16 and the link components connected thereto arranged on the right side and those arranged on the left side are moved while being kept in right-left symmetrical relation. Hence, in what follows, the structure and workings of the chair-type massage apparatus 1 will be described with reference to the left-hand side views thereof.

Figure 6:
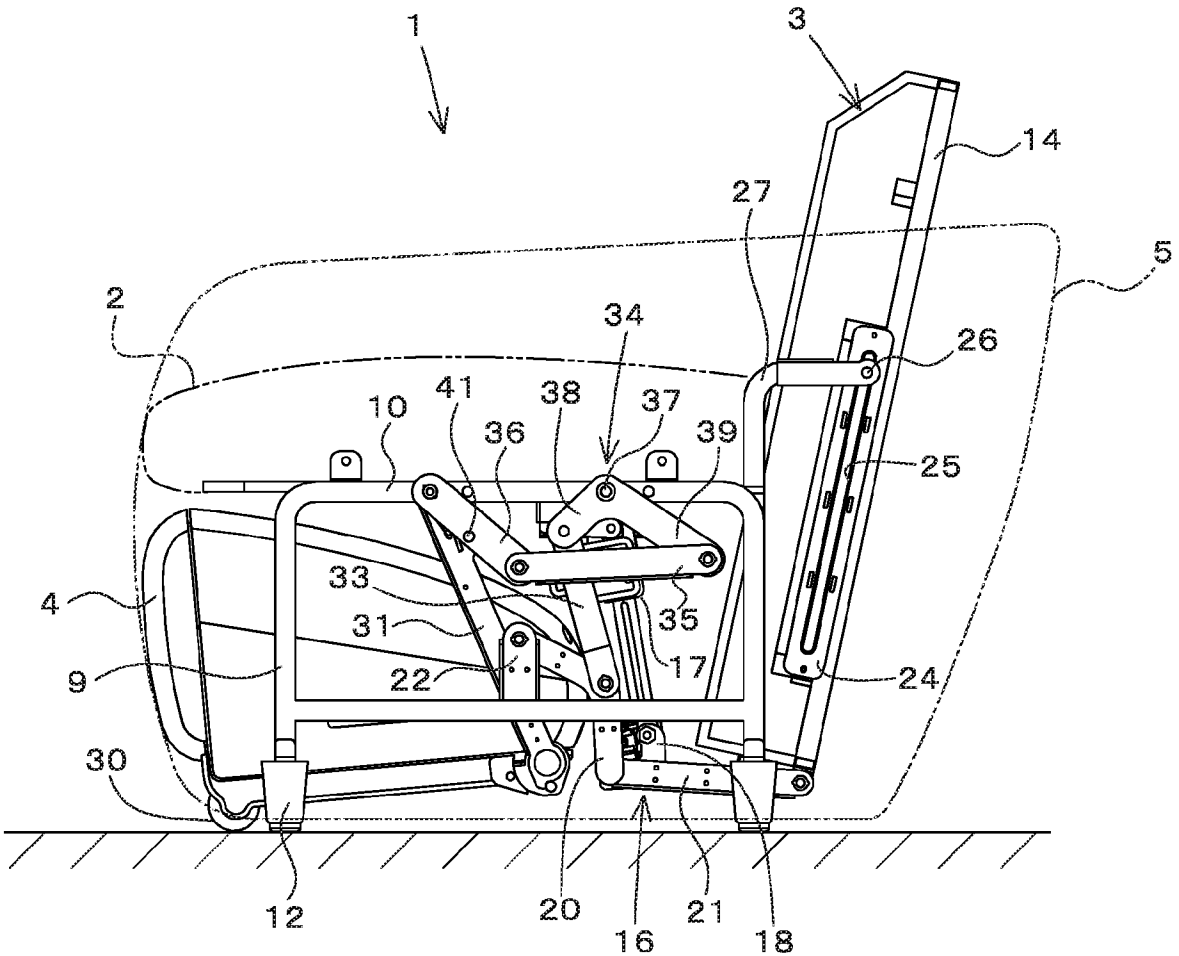
FIG. 6 is a side view showing the internal structure of the chair-type massage apparatus, with the backrest held in the housing position (First embodiment, housing position).
Figure 7:
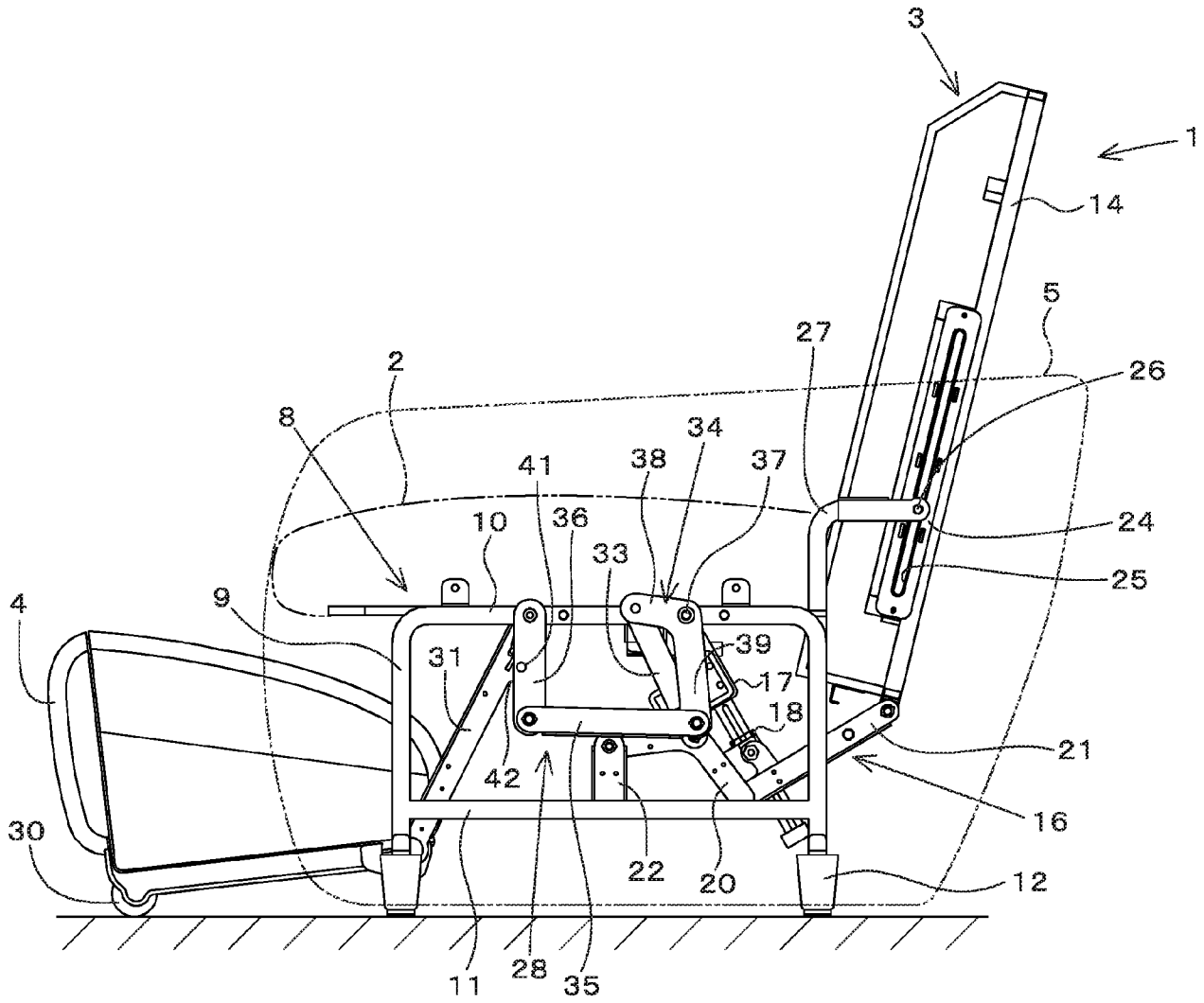
FIG. 7 is a side view showing the internal structure of the chair-type massage apparatus, with the backrest assuming the first protruding position (First embodiment, first protruding position).
Figure 8:
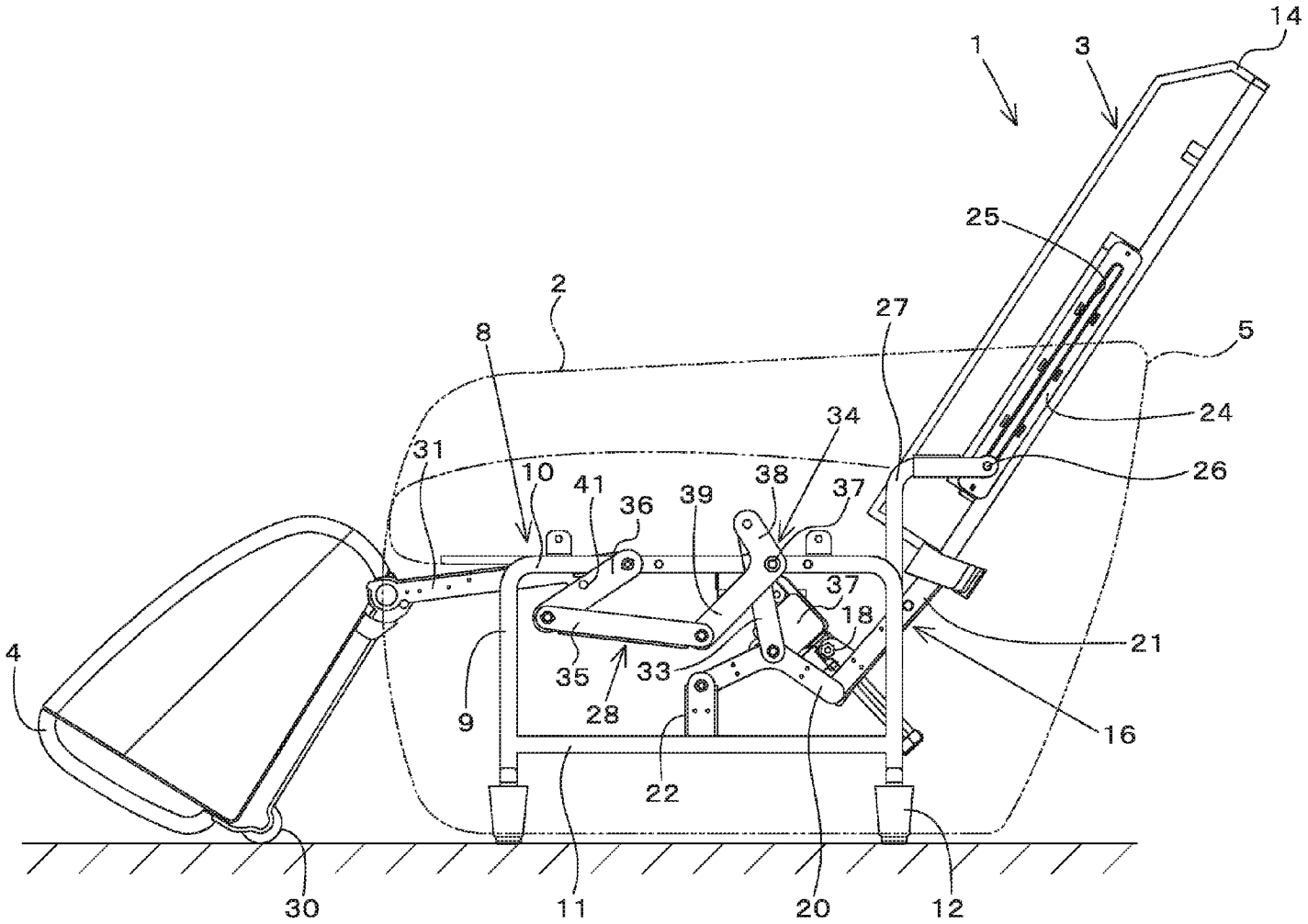
FIG. 8 is a side view showing the internal structure of the chair-type massage apparatus, with the backrest assuming the second protruding position (First embodiment, second protruding position).

As shown in FIGS. 6 to 8, the up-and-down link member 16 is built by joining a first member 20 located toward the base frame 8 and a second member 21 located toward the backrest 3 together in a single-piece structure. More specifically, when viewed from the left, the up-and-down link member 16 is convexly curved downward to form a bend, and this configuration is made by combining the first member 20 and the second member 21 together in substantially L shape.

As shown in FIG. 6, the first member 20 is a strip-like member which is, when viewed from the left, convexly curved upward to form a bend, expressed differently, is bent in substantially L shape (boomerang-like shape). The first member 20 is, at one end (front end), pivotally supported on the front end (upper end) of a projection 22 extending upward from the midpoint of the lower frame 11 of the base frame 8, for free rocking motion about the right-left axis relative to the lower frame 11 (the base frame 8). Moreover, the other end (rear end) of the first member 20 is formed with the coupling rod 19 whereby the right-hand and left-hand first members 20 can be fixedly connected to each other at their other ends. The coupling rod 19 is a rodlike member for coupling together the other ends of, respectively, the right-hand and left-hand first members 20. As shown in FIG. 4, the mobile element 18 of the link driving section 17 is coupled to a position midway between the opposite ends of the coupling rod 19 in the right-left direction.

As shown in FIG. 6, the second member 21 is a long strip-like member which is, when viewed from the left, extended linearly along the floor and acts as the connection between the lower end of the backrest 3 and the other end of the first member 20. The second member 21 has its one end (front end) secured to the other end of the first member 20, to be more precise, secured integrally to the coupling rod 19, for free rocking motion about the right-left axis on the front end of the above-described first member 20 as a pivot, and has its other end (rear end) coupled to the lower end of the backrest 3 for free rocking motion. In response to the rocking motion of the up-and-down link member 16 about the right-left axis on its one end as a pivot, the lower end of the backrest 3 is rocked, so that the backrest 3 moves up and down.

It is preferable that the second member 21 of the up-and-down link member 16 as above described is so disposed that it becomes substantially parallel with the floor when the backrest 3 is held in the housing position. This makes it possible to bring the vertical position of the up-and-down link member 16 nearer to the floor, and thereby lower the backrest 3 to the extent that it can be placed as close to the floor as possible for storage.

As shown in FIG. 5 for example, the link driving section 17 is a long member for producing power to rock the backrest 3 and the footrest 4 relative to the base frame 8. In the first embodiment, an electric linear actuator is used for the link driving section 17, wherein the mobile element 18 formed on the front-end side moves longitudinally closer to and away from the basal end (travels) under a torque produced by an electric motor.

More specifically, as shown in FIG. 5, the link driving section 17 is coupled at its basal end relatively to the upper frame 10 of the base frame 8, to be more precise, coupled to a position midway between the opposite ends of a hanging frame 23 disposed across the right-hand and left-hand upper frames 10 in the right-left direction, for free rotation about the right-left axis. The mobile element 18 of the link driving section 17 is coupled to a position midway between the opposite ends of the above-described coupling rod 19 in the right-left direction for free rotation about the right-left axis.

Thus, as the mobile element 18 of the link driving section 17 is moved toward the basal end, the coupling rod 19 coupled to the mobile element 18 is moved upward correspondingly, thereby causing the other end of the up-and-down link member 16 to rock in a counterclockwise direction as viewed in FIGS. 6 to 8 on one end as a pivot. That is, when the backrest 3 is held in the housing position as shown in FIG. 6, the other end of the up-and-down link member 16 is located below the level of one end thereof. However, when the up-and-down link member 16 is rocked into a position as shown in FIG. 8, the other end of the up-and-down link member 16 is located above the level of one end, whereupon the backrest 3 coupled to the other end of the up-and-down link member 16 is moved upward (raised) to a position located above the housing position. On the other hand, as the mobile element 18 of the link driving section 17 is moved away from the basal end, the coupling rod 19 is moved downward correspondingly, thereby causing the other end of the up-and-down link member 16 to rock in a clockwise direction as viewed in FIGS. 6 to 8 on one end as a pivot. In consequence, the backrest 3 is moved downward to the housing position.

In the chair-type massage apparatus 1 of the first embodiment, in addition to the up-and-down means 15 as above described, there is provided a guide mechanism 24 for guiding the backrest 3 in vertical up-and-down movement. The guide mechanism 24 is composed of a long guide slot 25 provided at a side surface of the backrest 3 so as to extend in the direction of the length of the backrest 3, and a position-holding section 26 which is slidably fitted in the guide slot 25 for holding the position of the backrest 3 during its up-and-down movement.

The guide slot 25 is formed in the backrest frame 14 extending in the direction of the length of the backrest 3, and has the shape of a long hole elongated in the direction of the length of the backrest 3. The guide slot 25 is formed at each of the right side surface and the left side surface of the backrest 3. Each of the guide slots 25 is so formed as to pass completely through the backrest frame 14 in the right-left direction.

The position-holding section 26 is a pin member which is slidably fitted in the guide slot 25 to perform the function of holding the position of the backrest 3 during its up-and-down movement. As is the case with the guide slot 25, one position-holding section 26 is formed on each of the right and left sides. The right-hand and left-hand position-holding sections 26 are fitted in the right-hand and left-hand guide slots 25, respectively, thereby guiding the backrest 3 in its lengthwise direction.

More specifically, the above-described base frame 8 is formed with a backrest support frame 27 extending from the upper frame 10 toward the rear, for supporting the backrest 3. The backrest support frame 27 extends upwardly and further rearwardly from the upper-rear part of the base frame 8, and is, like the base frame 8, built from metal pipe members, angle bars, or the like. The backrest support frame 27 branches at its pointed end into two portions that have sandwiched therebetween each of the guide slot 25, and the pin member (the position-holding section 26) is inserted into the guide slot 25. Since the position-holding section 26 is fitted loosely for free rotation relative to the guide mechanism 24, it follows that the backrest 3 can be moved upward with rocking motion.

With the provision of such a guide mechanism 24, even during the rocking motion of the up-and-down link member 16 as above described, the backrest 3 can be supported at two specific lower and upper points, namely the lower end coupled to the up-and-down link member 16 and the position-holding section 26 of the guide mechanism 24. This allows the backrest 3 to move rockably up and down with postural stability.

Meanwhile, the chair-type massage apparatus 1 of the first embodiment has the footrest 4 for massaging user's lower legs. Therefore, a linking mechanism 28 is provided to rock such a footrest 4 back and forth in response to the movement of the up-and-down means 15 as above described.

The footrest 4 is box-shaped, and has a pair of right-hand and left-hand leg-receiving recesses 29 for massaging the lower leg (leg part below the calf) of a user. Moreover, the lower surface of the footrest 4 is formed with a pair of right-hand and left-hand wheels 30 to impart back-and-forth motion to the footrest 4. Further, between the footrest 4 and the base frame 8 is disposed a footrest rocking link member 31 for rocking the footrest 4 relative to the base frame 8.

The footrest rocking link member 31 is an arm member for rockably coupling the footrest 4 to the base frame 8. The footrest rocking link member 31 has its front end (one end) coupled to the footrest 4 for free rocking motion about the right-left axis, and has its basal end (other end) coupled substantially centrally of the upper frame 10 constituting the base frame 8 in the front-rear direction, for free rocking motion about the right-left axis.

Moreover, the footrest rocking link member 31 has formed at its basal end a coil spring 32 for urging the footrest rocking link member 31 to rotate in the counterclockwise direction (in the direction to store the footrest 4).

In the state as shown in FIGS. 1A and 2A, the footrest 4 is stored under the seat 2, with the leg-receiving recesses 29 facing upward. In order to effect a massage, as shown in FIGS. 2A to 2C, the footrest 4 is pulled forward from the location under the seat 2, and is thereupon rocked on its side formed with the above-described wheels 30 (front end-side, in the illustrated example) as a pivot, with another side coupled to the footrest rocking link member 31 (rear end-side) uprising quickly. Then, as shown in FIGS. 1B and 2C, in its fully-advanced, or forwardmost position (second protruding position), the footrest 4 rises, with the leg-receiving recesses 29 facing forward. In consequence, the footrest 4 stands ready to massage the lower legs of a user. Note that the storage of the footrest 4 can be made by reversing the procedure thus far described.

The above-described footrest 4 is free to advance to a position ahead of the seat 2 from the location under the seat 2, as well as to retract into the location under the seat 2 from that position, in response to the movement of the up-and-down means 15 by means of the linking mechanism 28.

As shown in FIGS. 6 to 8, the linking mechanism 28 comprises a plurality of link members capable of movement in response to the rocking motion of the up-and-down link member 16 as above described.

More specifically, the linking mechanism 28 is composed of a combination of first to fourth link members 33 to 36 that will hereafter be described.

As shown in FIGS. 6 to 8, the first link member 33 is a long strip-like member placed so as to point in the vertical direction. The first link member 33 has its lower end coupled to the midpoint of the first member 20 of the up-and-down link member 16, to be more precise, coupled to the substantially L-shaped bend of the first member 20, for free vertical movement in synchronization with the rocking motion of the up-and-down link member 16, and has its upper end coupled to the second link member 34.

The second link member 34 is a platy member which has a substantially L shape when viewed laterally and therefore has a bend at its midpoint. The bend is formed with a rocking shaft 37 for securing the second link member 34 for free rocking motion about the right-left axis to the upper frame 10 of the base frame 8. The second link member 34 includes two short and long side portions extending in different directions from the rocking shaft 37 (the center of rocking motion). To the pointed end of the shorter one of the two side portions (the short side portion 38), the upper end of the first link member 33 is coupled for free rocking motion about the right-left axis. Coupled to the pointed end of the longer one of the two side portions (the long side portion 39) of the second link member 34 is the third link member 35.

The use of such a second link member 34 makes it possible to transmit the amount of rocking motion of the up-and-down link member 16, which has been fed to the short side portion 38, to the third link member 35 while producing an increase in rocking distance. In other words, the second link member 34 serves as a rocking amount adjustment member for adjusting the amount of rocking motion of the up-and-down link member 16 so that it increases to the amount of rocking motion of the footrest rocking link member 31 for moving the footrest 4, and then transmitting that rocking amount.

That is, in general, the amount of link-member rocking motion required to impart upward (downward) movement to the backrest 3 and that required to impart forward (backward) movement to the footrest 4 differ from each other. Therefore, as is the case with the first embodiment, where the amount of rocking motion of the footrest 4 needs to be greater than the amount of rocking motion of the backrest 3, by transmitting the amount of rocking motion of the up-and-down link member 16 to the footrest 4 after increasing that amount by the rocking amount adjustment member, it is possible to operate the footrest 4 and the backrest 3 in time with each other.

The third link member 35 is a long strip-like member placed below the upper frame 10 of the base frame 8. As shown in FIGS. 6 to 8, the third link member 35 is disposed along the front-rear direction in substantially parallel relation to the upper frame 10. The third link member 35 has its other end (rear end) coupled to the long side portion 39 of the above-described second link member 34, and has its one end (front end) coupled to the fourth link member 36. Thus, the use of the third link member 35 allows transmission of a driving-force output produced from the long side portion 39 of the second link member 34 to the fourth link member 36.

The fourth link member 36 is a long strip-like member which is rocked in the same direction as the direction of rotation of the long side portion 39 of the above-described second link member 34 (in the counterclockwise direction viewing FIG. 6). The fourth link member 36 has its basal end (upper end) pivotally supported on the upper frame 10 of the base frame 8 for free rocking motion as is the case with the second link member 34, and has its front end (lower end) made to be rockable about the right-left axis on the basal end as a pivot.

As shown in FIG. 3, the fourth link member 36 has, at its lengthwise midpoint, a rodlike abutment portion 41 disposed so as to run across the right-hand and left-hand fourth link members 36 whereby the fourth link members 36 can be fixedly coupled to each other at their midpoints.

Meanwhile, the footrest rocking link member 31 has, in a position near its basal end, a fit portion 42 formed so as to correspond to the abutment portion 41. The fit portion 42 is fitted disengageably to the abutment portion 41. When the fourth link member 36 is rocked at the front end forward on the basal end as a pivot under a condition where the abutment portion 41 of the fourth link member 36 is kept in engagement with the fit portion 42 of the footrest rocking link member 31, then the footrest rocking link member 31 is pushed forward by the fourth link member 36, and is thereupon rocked in a direction from the rear to the front. In consequence, the footrest 4 is moved forward (advanced) against the urging force of the coil spring 32 as above described.

On the other hand, when the fourth link member 36 is rocked at the front end backward on the basal end as a pivot, under the urging force of the coil spring 32 as above described, the footrest rocking link member 31 is rocked in a direction from the front to the rear in response to the rocking motion of the fourth link member 36, with the abutment portion 41 still kept in engagement with the fit portion 42. In consequence, the footrest 4 is moved backward (retracted).

It is noted that, during the backward movement of the footrest 4, if the footrest 4 is subjected to a load which is so great as to hold its position, the abutment portion 41 will be disengaged from the fit portion 42, thereby releasing the linking (engagement) between the fourth link member 36 and the footrest rocking link member 31. Therefore, even if some trouble such as an accidental entanglement is encountered during the storage of the footrest 4, it is possible to ensure safety. That is, the fourth link member 36 can be considered also as a link member constituting a safety mechanism.

Next, a description will be given below as to operation for upward travel of the backrest 3, as well as advancement and retraction of the footrest 4 in response to up-and-down movement of the backrest 3, using the up-and-down means 15 and the linking mechanism 28 thus far described.

In the chair-type massage apparatus 1 as shown in FIG. 6, in order to push the backrest 3 upward and move the footrest 4 forward as well, the link driving section 17 is actuated so that the mobile element 18 moves longitudinally from the front end toward the basal end (moves closer to the basal end).

Then, the coupling rod 19 coupled to the mobile element 18 of the link driving section 17 (the coupling rod 19 whereby the right-hand and left-hand up-and-down link members 16 can be coupled to each other at their midpoints in the right-left direction) is moved upward, thereby causing the other end (rear end) of the up-and-down link member 16 to rock upward about the right-left axis (rock counterclockwise, in the illustrated example) on one end (front end). In consequence, the backrest 3 coupled to the other end of the up-and-down link member 16 is moved upward on one end of the up-and-down link member 16 as a pivot, and is thereupon raised greatly from the housing position toward the first protruding position.

Upon the backrest 3 rising to the first protruding position, the other end of the up-and-down link member 16 is located above the level of one end thereof. From then on the up-and-down link member 16 is rocked at the other end forward on one end as a pivot.

That is, as the other end of the up-and-down link member 16 is rocked forward on one end as a pivot, the lower end of the backrest 3 is moved forward correspondingly. At this time, while the lower end of the backrest 3 moves forward, the upper end thereof is restrained from forward movement, with the consequence that the backrest 3 is tilted backward. In this way, upon its travel from the first protruding position to the second protruding position, the backrest 3 is tilted backward into a reclined condition.

Meanwhile, as shown in FIG. 6, when the up-and-down link member 16 is rocked at the other end counterclockwise on one end as a pivot, then the first link member 33 coupled to the midpoint of the first member 20 of the up-and-down link member 16 is moved upward correspondingly. In response to the upward movement of the first link member 33, the second link member 34 is rotated clockwise on the rocking shaft 37.

That is, coupled to the front end of the short side portion 38 of the second link member 34 is the upper end of the first link member 33, and coupled to the front end of the long side portion 39 of the second link member 34 is the rear end of the third link member 35. The second link member 34 has the short side portion 38 on the left side of the rocking shaft 37, and has the long side portion 39 on the right side of the rocking shaft 37. Therefore, upon the upward movement of the first link member 33, the second link member 34 is rotated clockwise about the right-left axis, with the short side portion 38 located on the left side of the rocking shaft 37 moving upward. In response to the rotation of the second link member 34, the front end of the long side portion 39 of the second link member 34 is rotated in the clockwise direction, thereby causing the third link member 35 coupled to the front end of the long side portion 39 to move forward.

As the third link member 35 is moved forward in that way, the fourth link member 36 coupled to the third link member 35 is rocked correspondingly. That is, since the front end (lower end) of the fourth link member 36 is coupled to the front end of the third link member 35, in response to the forward movement of the third link member 35, the fourth link member 36 is rocked at the front end forward (in the clockwise direction) on the basal end (upper end) as a pivot, as is the case with the second link member 34. In other words, the second to fourth link members 34 to 36 constituting the linking mechanism 28 form a parallel link mechanism for transmitting a driving force from the link driving section 17, which has been fed thereto through the first link member 33, to the footrest rocking link member 31.

Thus, as the fourth link member 36 is rocked at the front end forward in the clockwise direction on the basal end as a pivot, the abutment portion 41 formed at the lengthwise midpoint of the fourth link member 36 acts to push the footrest rocking link member 31 forward, thereby causing the front end of the footrest rocking link member 31 to rock in the clockwise direction on the basal end as a pivot. In consequence, the footrest 4 is moved (rocked) forward in synchronization with the rocking motion of the footrest rocking link member 31. That is, in response to the upward travel of the backrest 3 from the housing position as shown in FIG. 6 to the protruding position (the second protruding position) as shown in FIG. 8, the footrest 4 is moved forward from the location under the seat 2.

In order to move the backrest 3 toward the region below the seat 2, as well as to move the footrest 4 backward (retract the footrest 4), by reversing the procedure thus far described, the backrest 3 and the footrest 4 can be stored in place.

That is, in the state as shown in FIG. 8, by actuating the link driving section 17 so that the mobile element 18 thereof moves longitudinally toward the front end, the up-and-down means 15 can be operated in reverse order to the way it is operated as above described, thereby causing the backrest 3 to stand up (return to the first protruding position). Then, by actuating the link driving section 17 further, the backrest 3 is moved downward into the housing position. Moreover, the linking mechanism 28 is operated in reverse order to the way it is operated as above described, thereby causing the footrest 4 to move backward (retract) under the urging force of the coil spring 32 as above described so as to return to the location under the seat 2.

As described heretofore, according to the chair-type massage apparatus 1 of the first embodiment, even if the chair-type massage apparatus 1 is designed as a mini couch-type massage apparatus having a low-height backrest 3, with use of the up-and-down means 15 mounted in the chair-type massage apparatus 1, the backrest 3 can be readily moved so as to protrude from the housing position to the protruding position (the first and second protruding positions). This allows a user to have an adequate and reliable back massage in a stress-free comfortable position.

Moreover, with use of the linking mechanism 28 for moving the footrest 4 forward in response to the movement of the up-and-down means 15, the footrest 4 can be moved back and forth by exploiting a driving force from the link driving section 17 used for the up-and-down movement of the backrest 3.

Further, with the provision of the rocking amount adjustment member for transferring the amount of rocking motion of the up-and-down link member 16 for moving the backrest 3 after changing it to the amount of rocking motion of the footrest rocking link member 31 for moving the footrest 4, for example, where the amount of rocking motion of the footrest 4 needs to be greater (smaller) than the amount of rocking motion of the backrest 3, by adjusting the amount of rocking motion of the up-and-down link member 16 in conformity to the amount of rocking motion of the footrest 4, it is possible to operate the footrest 4 and the backrest 3 in time with each other.

Next, a chair-type massage apparatus 1 in accordance with the second embodiment will be described.

Firstly, as shown in FIGS. 9 to 12, the chair-type massage apparatus 1 comprises a seat 2 and a backrest 3 mounted at the rear of the seat 2. Moreover, a footrest 4 capable of massaging the lower legs of a user is set under the seat 2, and an armrest 5 is disposed on each of the right side and the left side of the seat 2 for the resting of the forearm of a user sitting on the seat 2.

In the following description, the direction of from right to left (left to right) as viewed in FIGS. 9 to 11 will be referred to as the front-rear direction for explaining the chair-type massage apparatus 1, and the direction of from top to bottom (bottom to top) as viewed in FIGS. 9 to 11 will be referred to as the vertical direction for explaining the chair-type massage apparatus 1. Moreover, the direction of drilling through the paper sheet with each of FIGS. 9 to 11 printed on it will be referred to as the right-left direction or widthwise direction for explaining the chair-type massage apparatus 1. The above definitions of directions are based on the sight of a user sitting on the chair-type massage apparatus 1.

Figure 9:
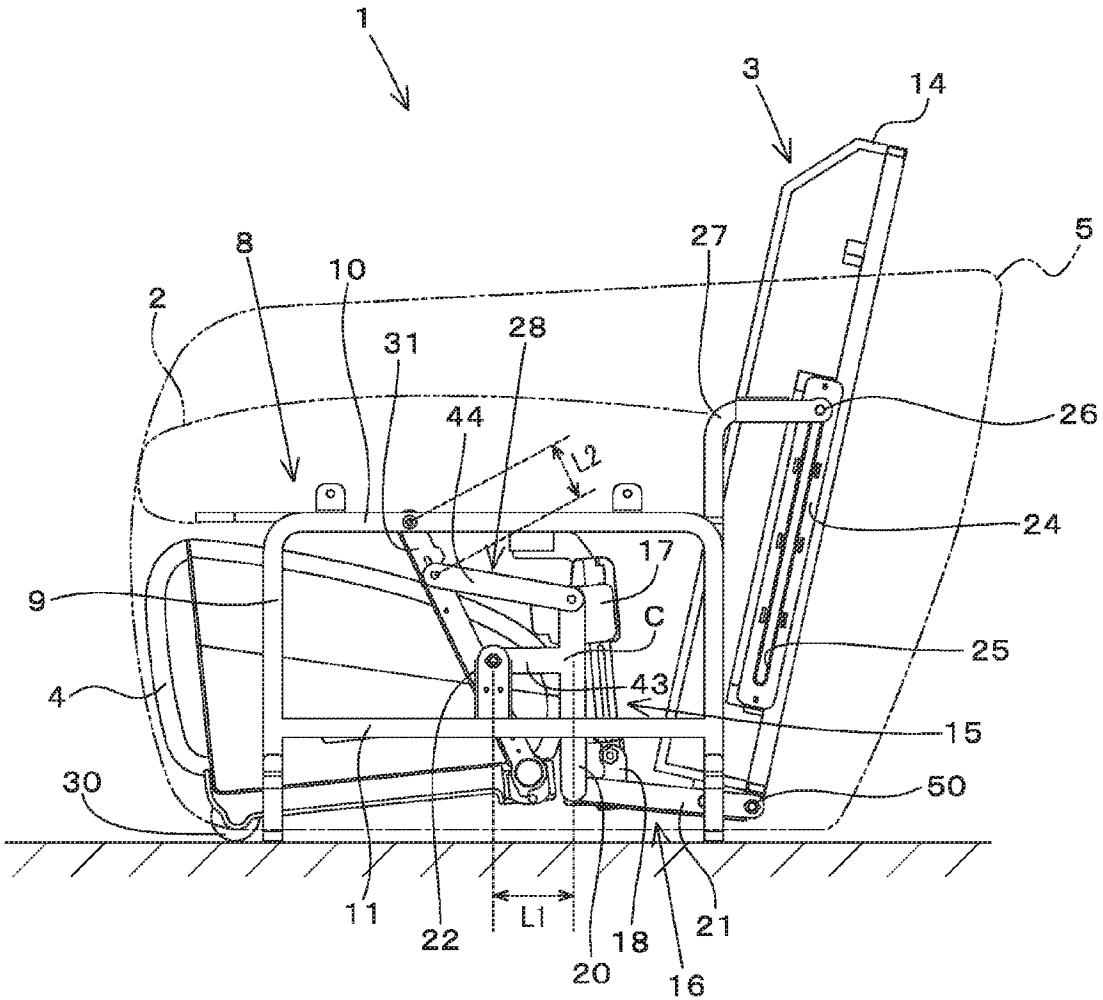
FIG. 9 is a side view showing the internal structure of the chair-type massage apparatus, with the backrest held in the housing position (Second embodiment, housing position).
Figure 10:
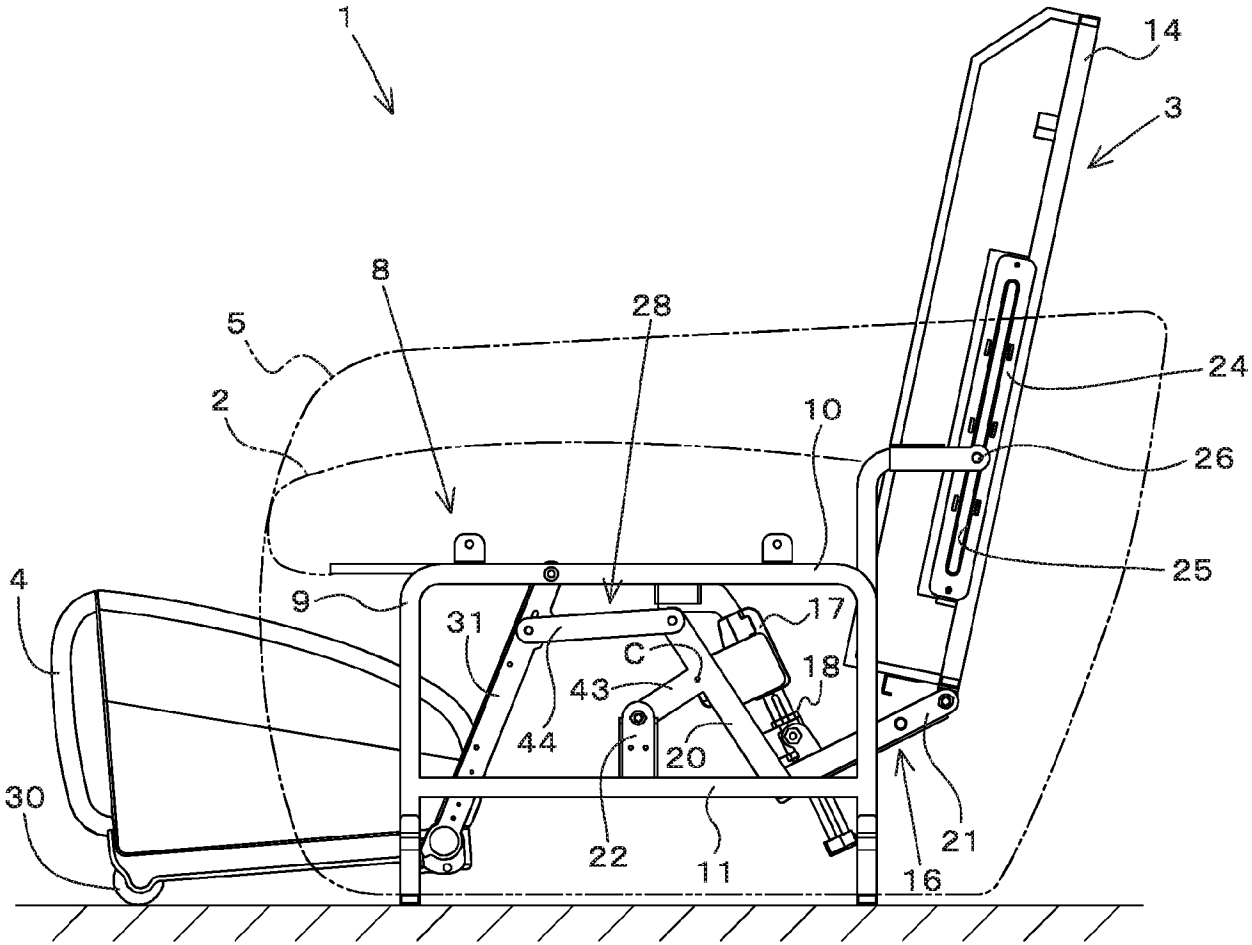
FIG. 10 is a side view showing the internal structure of the chair-type massage apparatus, with the backrest assuming the first protruding position (Second embodiment, first protruding position).
Figure 11:
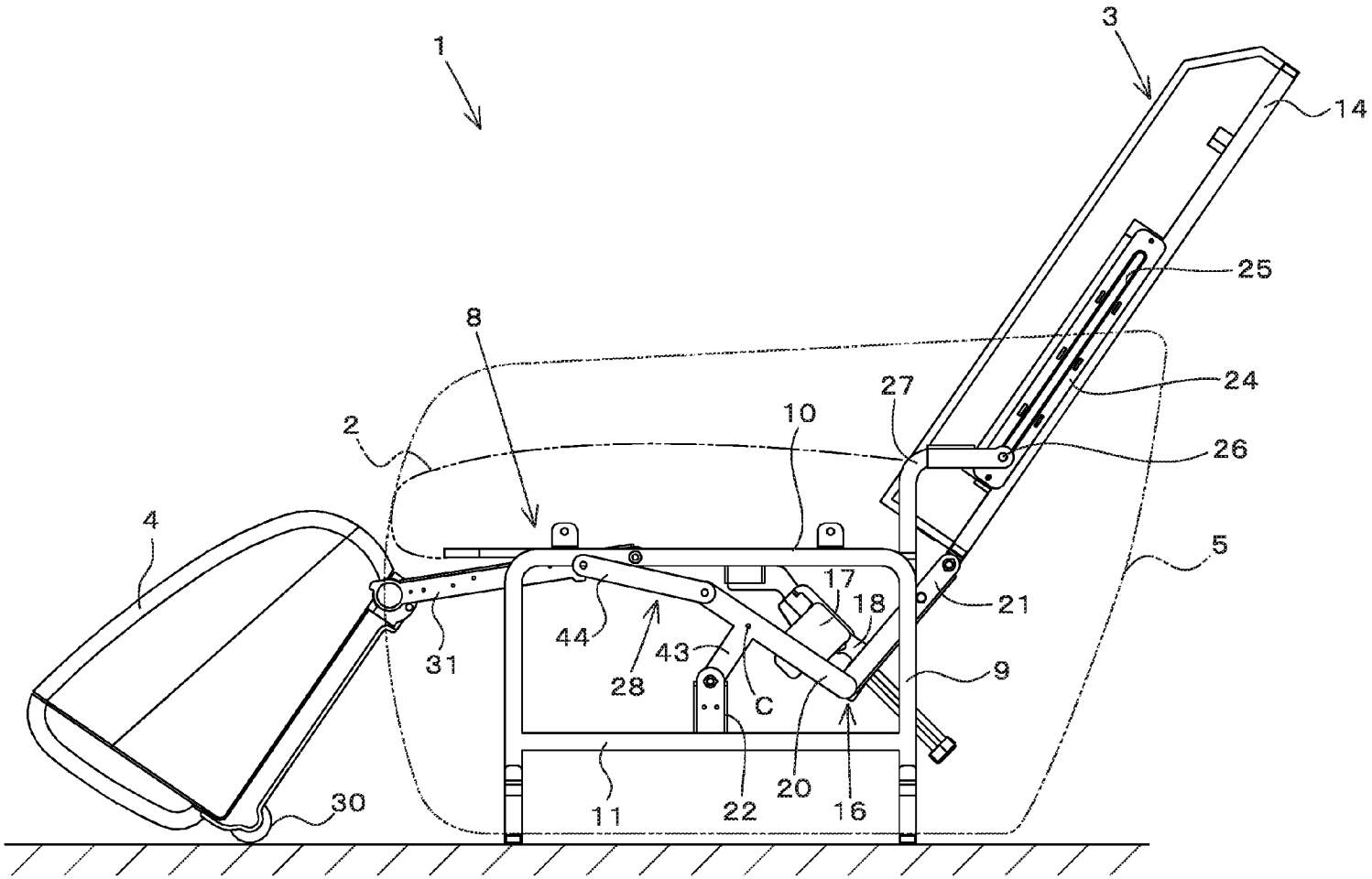
FIG. 11 is a side view showing the internal structure of the chair-type massage apparatus, with the backrest assuming the second protruding position (Second embodiment, second protruding position).

Looking at a transition from the state shown in FIG. 9 to the state shown in FIG. 10 and from there to the state shown in FIG. 11, it will be seen that the above-described backrest 3 is configured to move greatly upward from a housing position, where the lower part of the backrest 3 is stored under the seat 2, toward a first protruding position located above the housing position (where the backrest 3 is extended upward), and then tilt backward toward a second protruding position located behind the first protruding position (where the backrest 3 is tilted backward into a reclined condition). As indicated by broken lines, the backrest 3 has a built-in massage section 6 for massaging the back and waist of a user.

Moreover, the footrest 4 is also configured to move forward from the location under the seat 2 (housing position) to a protruding position (working position) in response to the upward movement (rising movement) of the backrest 3. Although not shown in the figure, the footrest 4 has a built-in foot massage section for massaging the lower legs of a user.

Next, the seat 2, the backrest 3, the footrest 4, and the armrest 5 constituting the chair-type massage apparatus 1 of the second embodiment will be described in detail.

The seat 2, which is a rectangular member having an area large enough to support the buttocks of a sitting user from below, is made of a cushion material. Under the seat 2 is disposed a base frame 8 whereby the seat 2 is supported at a position spaced above a floor.

As shown in FIGS. 9 to 12, the base frame 8 is built in the form of a framework by combining a plurality of metal pipe members, angle bars, and the like together. The base frame 8, which acts as support forbearing the full weight of the chair-type massage apparatus 1 on the floor, is capable of not only supporting the above-described seat 2, but also bearing the weights of the footrest 4 and the backrest 3 and the weight of a user sitting on the seat 2 as well.

The base frame 8 comprises: four column support frames 9 extending in the vertical direction in upstanding condition, the lower ends of which are grounded on the floor; a horizontally running upper frame 10 mounted for fixed connection between the upper ends of the column support frames 9; and a horizontally running lower frame 11 mounted below the upper frame 10 for fixed connection between the lower ends of the column support frames 9.

The column support frames 9 are located at the four corners of the seat 2, respectively. In other words, one column support frame 9 is disposed in a location corresponding to each of the left front corner, the right front corner, the left rear corner, and the right rear corner of the seat 2, viz., there are four column support frames 9 in all. The upper frame 10 is a cross-member which runs horizontally across the column support frames 9 arranged side by side, or arranged adjacent each other in the front-rear direction, for providing connection between the upper ends of the adjacent column support frames 9. The above-described seat 2 is placed on the upper frame 10. Like the upper frame 10, the lower frame 11 is also a cross-member which runs horizontally across the column support frames 9 arranged side by side, or arranged adjacent each other in the front-rear direction, for providing connection between the lower ends of the adjacent column support frames 9. Note that the column support frame 9 has formed at its lower end a non-slip member 12 capable of preventing slippage of the massage apparatus on the floor.

As described just above, the column support frames 9 are spaced apart in the front-rear direction and the right-left direction; the upper frames 10, as well as the lower frames 11, are spaced apart in the right-left direction; and the upper frame 10 and the lower frame 11 are spaced apart in the vertical direction. That is, these frames are so arranged as to secure enough space for the placement of structural components. The footrest 4 can therefore be stored inside the base frame 8.

There is provided a pair of right-hand and left-hand armrests 5 that are situated on the right side and the left side, respectively, of the above-described seat 2, for the resting of the forearm of a sitting user. The armrest 5 is a board-like member disposed in upstanding condition, with its board surface facing sideward (rightward or leftward). The upper end face of the armrest 5 is substantially flat-shaped for easiness in the resting of the forearm of a user. The armrest 5 may be configured to have, at its surface facing inward in the widthwise direction, a massage section for giving a massage such as a kneading massage, a tapping massage, or a vibratory massage to the waist, thighs, or ether body part of a user sitting on the seat 2.

The backrest 3 is a member which has a substantially rectangular shape when viewed from the front, the area of which is large enough to support user's back. In the illustrated example, the width of the backrest 3 in the right-left direction is substantially the same as that of the seat 2. Moreover, the backrest 3 is made with an increased thickness to bear the weight of the upper half of user's body.

Inside the backrest 3, there are provided a backrest frame 14 built by combining metal pipe members or the like together, for bearing, as is the case with the seat 2, the weight of a user leaning at his/her back on the backrest; a cushion material supported by the backrest frame 14; and a massage section 6 for giving a massage such as a kneading massage, a tapping massage, or a vibratory massage to the body of a user sitting on the seat 2 between the back and waist regions.

In the chair-type massage apparatus 1 of the second embodiment, as shown in FIG. 9, when it is not operated to give a massage to the back of a user (when the backrest 3 assumes the housing position), the upper end of the backrest 3 is located at substantially the same level as the upper surface of the armrest 5. That is, from outer appearance, the chair-type massage apparatus 1 of the second embodiment, being designed so that the upper end of the backrest 3 is located at exactly the same level as the upper surface of the armrest 5 or located slightly above the level of the upper surface of the armrest 5, is a certain type of chair falling under categories including e.g., stylish sofas and legless chairs. In this specification, a chair having such an appearance will be referred to as "mini couch-type chair". The chair-type massage apparatus 1 of the second embodiment can thus be considered as a mini couch-type massage apparatus.

However, even if it is desired to massage user's back, in particular, user's shoulder by using such a mini couch-type massage apparatus, in some cases, a shoulder massage cannot be performed because of the fact that the massage section does not reach the shoulder height. In order to avoid such an inconvenience, in the chair-type massage apparatus 1 of the second embodiment, the backrest 3 is mounted for up-and-down movement in the vertical direction.

More specifically, the chair-type massage apparatus 1 of the second embodiment is characterized by having up-and-down means 15 for switchably changing the height of the backrest 3 in the vertical direction within a range between a housing position (refer to FIG. 9) where the lower part of the backrest 3 is stored under the seat 2 and a protruding position where the lower part of the backrest 3 is raised to be located above the housing position. The protruding position involves a first protruding position (refer to FIG. 10) where the backrest 3 is in an upwardly-extending state and a second protruding position (refer to FIG. 11) where the backrest 3, while assuming the first protruding position (upwardly-extending state), is tilted backward into a reclined condition.

Even in the mini couch-type massage apparatus 1, by providing such an up-and-down means 15, it is possible to cause the backrest 3 to protrude when it is desired to massage user's back, and thereby allow a user to have a fully effective massage in a stress-free comfortable position.

Next, the up-and-down means 15 provided in the chair-type massage apparatus 1 of the second embodiment will be described.

As shown in FIGS. 9 to 12, the up-and-down means 15 of the second embodiment comprises an up-and-down link member 16 for moving the backrest 3 up and down relative to the above-described base frame 8, as well as causing the backrest 3 to rock about a right-left axis; and a link driving section 17 constructed of a linear actuator. The link driving section 17 is coupled to the up-and-down link member 16, so that the up-and-down link member 16 can be rocked by telescopic driving operation of the driving section 17.

More specifically, the up-and-down link member 16 has its one end (to be more precise, the tip of a root end 43 of a first member 20 constituting the up-and-down link member 16, which will hereafter be described in detail) coupled to the base frame 8 for free rocking motion about the right-left axis, and has its other end coupled to the lower end of the backrest 3. The link driving section 17 is coupled at its basal end to the base frame 8 for free rotation about the right-left axis. Moreover, in the link driving section 17, a mobile element 18 formed at the front end thereof is coupled to the midpoint of the up-and-down link member 16. As the front end-side mobile element 18 is moved closer to and away from the basal end, the up-and-down link member 16 is rocked about the right-left axis.

It is noted that the up-and-down link member 16 and each of link components connected to the up-and-down link member 16 are arranged on each of the right side and the left side of the seat 2 in symmetrical relation to each other, and the right-hand up-and-down link member 16 with link components and the left-hand up-and-down link member 16 with link components are coupled to each other in the widthwise direction by means of a coupling rod 19 which will hereafter be described or otherwise. Accordingly, the up-and-down link member 16 and the link components connected thereto arranged on the right side and those arranged on the left side are moved while being kept in right-left symmetrical relation. Hence, in what follows, the structure and workings of the chair-type massage apparatus 1 will be described with reference to the left-hand side views thereof.

As shown in FIGS. 9 to 12, the up-and-down link member 16 is built by joining the first member 20 located toward the base frame 8 and a second member 21 located toward the backrest 3 together in a single-piece structure. More specifically, when viewed from the left, the up-and-down link member 16 is convexly curved downward to form a bend, and this configuration is made by combining the first member 20 and the second member 21 together in substantially L shape.

As shown in FIG. 9, the first member 20 constituting the up-and-down link member 16 is a strip-like member having the shape of the letter T rotated 90° clockwise when viewed from the left. More specifically, given that the state as shown in FIG. 9 is a reference state, then the first member 20 includes three end portions that extend upward, downward, and leftward, respectively, from its center C. Of the three end portions, the leftwardly-extending end portion (root end 43) is, at its tip, pivotally supported on the front end (upper end) of a projection 22 extending upward from the midpoint of the lower frame 11 of the base frame 8. That is, the root end 43 of the first member 20 is mounted for free rocking motion about the right-left axis relative to the lower frame 11 (the base frame 8).

Moreover, one end (upper end) of the first member 20, more specifically, the end portion thereof that extends upward from the center C is pivotally supported on the rear end of an interlocking link member 44 (as will hereafter be described in detail) for free rocking motion about the right-left axis. Further, the other end (lower end) of the first member 20 is formed with the coupling rod 19 whereby the right-hand and left-hand first members 20 can be fixedly connected to each other at their other ends. The coupling rod 19 is a rodlike member for coupling together the other ends of, respectively, the right-hand and left-hand first members 20. The mobile element 18 of the link driving section 17 is coupled to a position midway between the opposite ends of the coupling rod 19 in the right-left direction.

As shown in FIG. 9, the second member 21 is a long strip-like member which is, when viewed from the left, extended linearly along the floor and acts as the connection between the lower end of the backrest 3 and the other end of the first member 20. The second member 21 has its one end secured to the other end of the first member 20, to be more precise, secured integrally to the coupling rod 19, for free rocking motion about the right-left axis on the above-described root end 43 of the first member 20 as a pivot, and has its other end (rear end) coupled to the lower end of the backrest 3 for free rocking motion. In response to the rocking motion of the other end of the up-and-down link member 16 about the right-left axis on the root end 43 as a pivot, the lower end of the backrest 3 is rocked, so that the backrest 3 moves up and down.

It is preferable that the second member 21 of the up-and-down link member 16 as above described is so disposed that, as shown in FIG. 9, it becomes substantially parallel with the floor when the backrest 3 is held in the housing position. This makes it possible to bring the vertical position of the up-and-down link member 16 nearer to the floor, and thereby lower the backrest 3 to the extent that it can be placed as close to the floor as possible for storage.

As shown in FIG. 11 for example, the link driving section 17 is a long member for producing power to rock the backrest 3 and the footrest 4 relative to the base frame 8. In the second embodiment, an electric linear actuator is used for the link driving section 17, wherein the mobile element 18 formed on the front-end side moves longitudinally closer to and away from the basal end (travels) under a torque produced by an electric motor.

Figure 12:
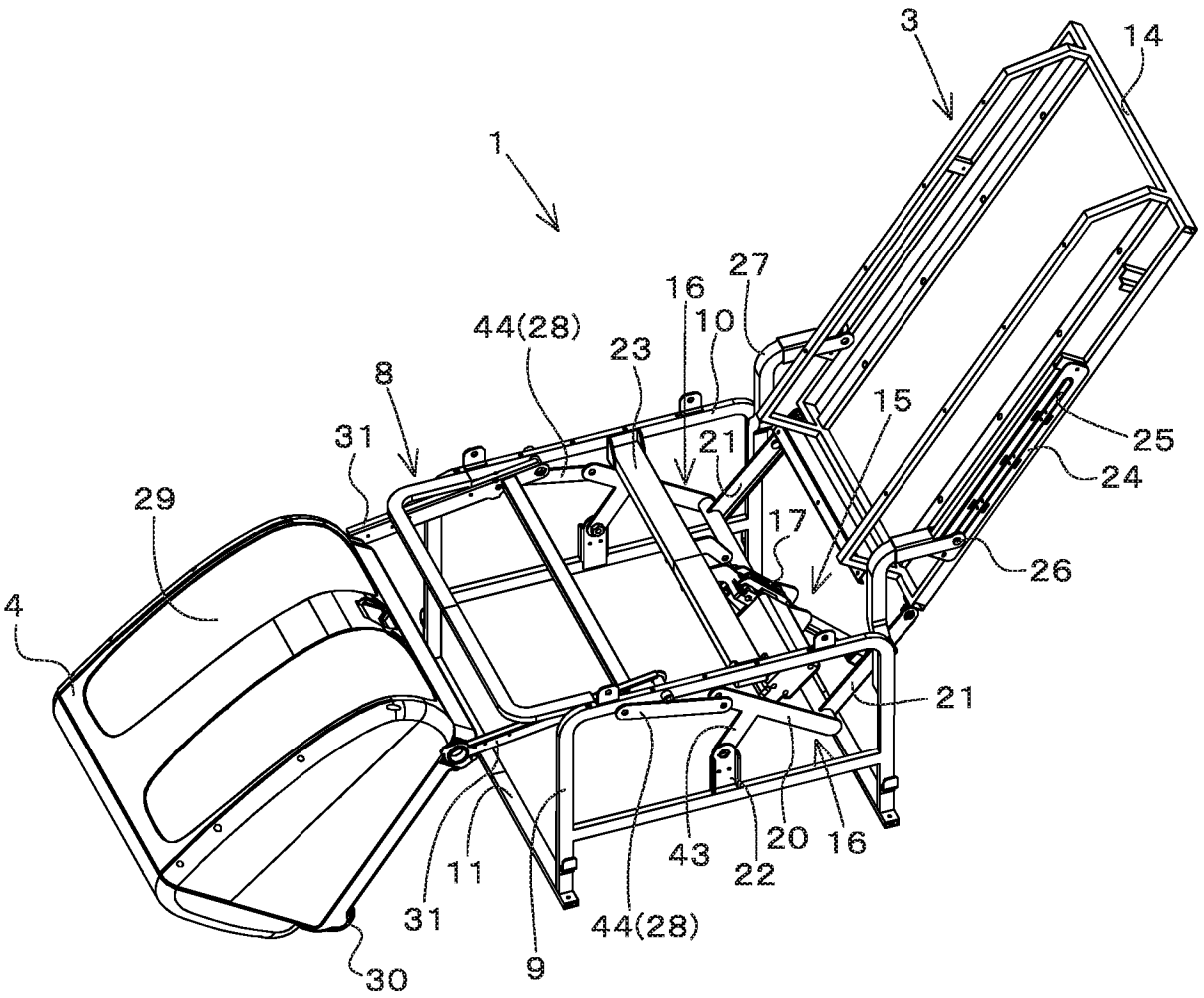
FIG. 12 is a front perspective view showing the internal structure of the chair-type massage apparatus (Second embodiment).

More specifically, as shown in FIGS. 11 and 12, the link driving section 17 is coupled at its basal end relatively to the upper frame 10 of the base frame 8, to be more precise, coupled to a position midway between the opposite ends of a hanging frame 23 disposed across the right-hand and left-hand upper frames 10 in the right-left direction, for free rotation about the right-left axis. The mobile element 18 of the link driving section 17 is coupled to a position midway between the opposite ends of the above-described coupling rod 19 in the right-left direction for free rotation about the right-left axis.

Thus, as the mobile element 18 of the link driving section 17 is moved closer to the basal end, the coupling rod 19 coupled to the mobile element 18 is moved upward correspondingly, thereby causing the other end (rear end) of the up-and-down link member 16 to rock in the counterclockwise direction as viewed in FIGS. 9 to 11 on the tip of the root end 43 as a pivot. That is, when the backrest 3 is held in the housing position as shown in FIG. 9, the other end of the up-and-down link member 16 is located below the level of the root end 43. However, when the up-and-down link member 16 is rocked into a position as shown in FIG. 11, the other end of the up-and-down link member 16 moves so as to be located at substantially the same level as the root end 43, whereupon the backrest 3 coupled to the other end of the up-and-down link member 16 is moved upward (raised) to a position located above the housing position. On the other hand, as the mobile element 18 of the link driving section 17 is moved away from the basal end, the coupling rod 19 is moved downward correspondingly, thereby causing the other end of the up-and-down link member 16 to rock in the clockwise direction as viewed in FIGS. 9 to 11 on the tip of the root end 43 as a pivot. In consequence, the backrest 3 is moved downward to the housing position.

In the chair-type massage apparatus 1 of the second embodiment, in addition to the up-and-down means 15 as above described, there is provided a guide mechanism 24 for guiding the backrest 3 in vertical up-and-down movement. The guide mechanism 24 is composed of a long guide slot 25 provided at a side surface of the backrest 3 so as to extend in the direction of the length of the backrest 3, and a position-holding section 26 which is slidably fitted in the guide slot 25 for holding the position of the backrest 3 during its up-and-down movement.

The guide slot 25 is formed in the backrest frame 14 extending in the direction of the length of the backrest 3, and has the shape of a long hole elongated in the direction of the length of the backrest 3. The guide slot 25 is formed at each of the right side surface and the left side surface of the backrest 3. Each of the guide slots 25 is so formed as to pass completely through the backrest frame 14 in the right-left direction.

The position-holding section 26 is a pin member which is slidably fitted in the guide slot 25 to perform the function of holding the position of the backrest 3 during its up-and-down movement. As is the case with the guide slot 25, one position-holding section 26 is formed on each of the right and left sides. The right-hand and left-hand position-holding sections 26 are fitted in the right-hand and left-hand guide slots 25, respectively, thereby guiding the backrest 3 in its lengthwise direction.

More specifically, the above-described base frame 8 is formed with a backrest support frame 27 extending from the upper frame 10 toward the rear, for supporting the backrest 3. The backrest support frame 27 extends upwardly and further rearwardly from the upper-rear part of the base frame 8, and is, like the base frame 8, built from metal pipe members, angle bars, or the like. The backrest support frame 27 branches at its pointed end into two portions that have sandwiched therebetween each of the guide slots 25, and the pin member (the position-holding section 26) passes through the guide slot 25 in the right-left direction. Since the position-holding section 26 is fitted loosely for free rotation relative to the guide mechanism 24, it follows that the backrest 3 can be moved upward with rocking motion.

With the provision of such a guide mechanism 24, even during the rocking motion of the up-and-down link member 16 as above described, the backrest 3 can be supported at two specific lower and upper points, namely the lower end coupled to the up-and-down link member 16 and the position-holding section 26 of the guide mechanism 24. This allows the backrest 3 to move rockably up and down with postural stability.

It is noted that, assuming the guide slot 25 is further extended downward along the direction of the length of the backrest 3 to a certain position, then, at this position is situated a pivotal point 50 on which the other end of the up-and-down link member 16 is supported by the backrest 3.

Meanwhile, the chair-type massage apparatus 1 of the second embodiment has the footrest 4 for massaging user's lower legs. Therefore, a linking mechanism 28 is provided to rock such a footrest 4 back and forth in response to the movement of the up-and-down means 15 as above described.

The footrest 4 is box-shaped, and has a pair of right-hand and left-hand leg-receiving recesses 29 for massaging the lower leg (leg part below the calf) of a user. Moreover, the lower surface of the footrest 4 is formed with a pair of right-hand and left-hand wheels 30 to impart back-and-forth motion to the footrest 4. Further, between the footrest 4 and the base frame 8 is disposed a footrest rocking link member 31 for rocking the footrest 4 relative to the base frame 8.

The footrest rocking link member 31 is an arm member for rockably coupling the footrest 4 to the base frame 8. The footrest rocking link member 31 has its front end (one end) coupled to the upper part of the footrest 4 for free rocking motion about the right-left axis, and has its basal end (other end) coupled substantially centrally of the upper frame 10 constituting the base frame 8 in the front-rear direction, for free rocking motion about the right-left axis.

Moreover, the footrest rocking link member 31 has formed at its basal end (the end toward the base frame 8) a coil spring 32 for urging the footrest rocking link member 31 to rotate in the counterclockwise direction (in the direction to store the footrest 4).

In the state as shown in FIG. 9, the footrest 4 is stored under the seat 2, with the leg-receiving recesses 29 facing upward. In order to effect a massage, as shown in FIGS. 9 to 11, the footrest 4 is pulled forward from the location under the seat 2, and is thereupon rocked on its side formed with the above-described wheels 30 (front end-side, in the illustrated example) as a pivot, with another side coupled to the footrest rocking link member 31 (rear end-side) uprising quickly. Then, as shown in FIG. 11, in its fully-advanced, or forward-most position (protruding position), the footrest 4 rises, with the leg-receiving recesses 29 facing forward. In consequence, the footrest 4 stands ready to massage the lower legs of a user. Note that the storage of the footrest 4 can be made by reversing the procedure thus far described.

The above-described footrest 4 is free to advance to a position ahead of the seat 2 from the location under the seat 2, as well as to retract into the location under the seat 2 from that position, in response to the movement of the up-and-down means 15 by means of the linking mechanism 28.

As shown in FIGS. 9 to 12, the linking mechanism 28 comprises a single interlocking link member 44 capable of movement in response to the rocking motion of the up-and-down link member 16 as above described.

As shown in FIGS. 9 to 12, the interlocking link member 44 is a long strip-like member placed below the upper frame 10 of the base frame 8. The interlocking link member 44 is disposed along the front-rear direction in substantially parallel relation to the upper frame 10.

The interlocking link member 44 has its other end (rear end) coupled to one end of the above-described first member 20 (T-shaped member) of the up-and-down link member 16, and has its one end (front end) coupled to a position midway between the opposite ends of the footrest rocking link member 31 in its lengthwise direction for free rocking motion about the right-left axis. Therefore, when the other end of the up-and-down link member 16 is rocked upward on the tip of the root end 43 as a pivot so that the first member 20 can be rotated counterclockwise, then the interlocking link member 44 is moved in a direction from the rear to the front correspondingly. In consequence, the footrest 4 is moved forward against the urging force of the coil spring 32 as above described. On the other hand, when the other end of the up-and-down link member 16 is rocked downward on the tip of the root end 43 as a pivot so that the first member 20 can be rotated clockwise, then the interlocking link member 44 is moved in a direction from the front to the rear correspondingly. In consequence, the footrest 4 is moved backward under the urging force of the coil spring 32.

Next, a description will be given below as to operation for upward travel of the backrest 3, as well as advancement and retraction of the footrest 4 in response to the movement of the backrest 3, using the up-and-down means 15 and the linking mechanism 28 (a single interlocking link member 44) thus far described.

In the chair-type massage apparatus 1 as shown in FIG. 9, in order to push the backrest 3 upward and move the footrest 4 forward as well, the link driving section 17 is actuated so that the mobile element 18 moves longitudinally toward the basal end (moves closer to the basal end).

Then, the coupling rod 19 coupled to the mobile element 18 of the link driving section 17 (the coupling rod 19 whereby the right-hand and left-hand up-and-down link members 16 can be coupled to each other at their midpoints in the right-left direction) is moved upward, thereby causing the other end (rear end) of the up-and-down link member 16 to rock upward about the right-left axis (rock counterclockwise, in the illustrated example) on the root end 43 as a pivot. In consequence, the backrest 3 coupled to the other end of the up-and-down link member 16 is moved upward on the root end 43 as a pivot, and is thereupon raised greatly from the housing position toward the first protruding position.

Upon the backrest 3 rising to the first protruding position, the other end of the up-and-down link member 16 is located at the same level as the root end 43. From then on the up-and-down link member 16 is rocked at the other end forward on the root end 43 as a pivot.

That is, as the other end of the up-and-down link member 16 is rocked forward on the root end 43 as a pivot, the lower end of the backrest 3 is moved forward correspondingly. At this time, while the lower end of the backrest 3 moves forward, the upper end thereof is restrained from forward movement, with the consequence that the backrest 3 is tilted backward. In this way, upon its travel from the first protruding position to the second protruding position, the backrest 3 is tilted into a reclined condition.

Meanwhile, as shown in FIG. 9, when the up-and-down link member 16 is rocked at the other end in the counterclockwise direction on one end as a pivot, then the interlocking link member 44 coupled to one end of the first member 20 of the up-and-down link member 16 is moved forward correspondingly. In response to the forward movement of the interlocking link member 44, the footrest rocking link member 31 is rotated clockwise, thereby causing the footrest 4 to move forward. In consequence, the backrest 3 is moved upward from the housing position as shown in FIG. 9 to the first protruding position as shown in FIG. 10, and from there to the protruding position as shown in FIG. 11 (second protruding position). In response to the upward travel of the backrest 3, the footrest 4 is moved forward from the location under the seat 2.

In order to move the backrest 3 downward for storage, as well as to move the footrest 4 backward (retract the footrest 4), by reversing the procedure thus far described, the backrest 3 and the footrest 4 can be stored in place.

That is, in the state as shown in FIG. 11, by actuating the link driving section 17 so that the mobile element 18 thereof moves longitudinally from the basal end toward the front end, the up-and-down means 15 can be operated in reverse order to the way it is operated as above described, thereby causing the backrest 3 to stand up (return to the first protruding position). Then, by actuating the link driving section 17 further so that the mobile element 18 moves nearer to the front end, the backrest 3 is moved downward into the housing position. Moreover, the interlock means is operated in reverse order to the way it is operated as above described, thereby causing the footrest 4 to move backward (retract) so as to return to the location under the seat 2 (housing position).

As described heretofore, according to the chair-type massage apparatus 1 of the second embodiment, even if the chair-type massage apparatus 1 is designed as a mini couch-type massage apparatus having a low-height backrest 3, with use of the up-and-down means 15 mounted in the chair-type massage apparatus 1, the backrest 3 can be readily moved so as to protrude from the housing position to the protruding position (the first and second protruding positions). This allows a user to have an adequate and reliable back massage in a stress-free comfortable position.

Moreover, with use of the linking mechanism 28 for moving the footrest 4 forward in response to the movement of the up-and-down means 15, the footrest 4 can be moved back and forth by exploiting a driving force from the link driving section 17 used for the up-and-down movement of the backrest 3.

Further, in the chair-type massage apparatus 1 of the second embodiment, by increasing a distance (L1) from the center C of the first member 20 having a substantially T shape when viewed laterally (substantially central part of the T shape) of the up-and-down link member 16 to that part of the first member which is coupled to the lower frame 11 (the tip of the root end 43, or the upper end of the projection 22 formed in the lower frame 11), it is possible to increase the amount of travel of the interlocking link member 44 which moves in response to the movement of the up-and-down link member 16. In consequence, the amount of rocking motion of the footrest rocking link member 31 can be larger than the amount of rocking motion of the up-and-down link member 16. Also by decreasing a distance (L2) from the center of rocking motion of the footrest rocking link member 31 to that part of the footrest rocking link member which is coupled to the interlocking link member 44, the amount of rocking motion of the footrest rocking link member 31 can be larger than the amount of rocking motion of the up-and-down link member 16.

Thus, in the chair-type massage apparatus 1 of the second embodiment, by making proper adjustment to the distance L1, L2, it is possible to operate the footrest 4 and the backrest 3 in time with each other (corresponding to the rocking amount adjustment member of the first embodiment).

Third Embodiment

Next, a chair-type massage apparatus 1 in accordance with the third embodiment will be described.

The chair-type massage apparatus 1 of the first embodiment, as well as the chair-type massage apparatus 1 of the second embodiment, is provided with the linking mechanism 28 for moving the footrest 4 back and forth in response to the movement of the up-and-down means 15 for moving the backrest 3 up and down. However, as will hereafter be exemplified by way of the third embodiment, the present invention may be practiced as a chair-type massage apparatus 1 of a type that the up-and-down operation of its backrest 3 and the back-and-forth movement of its footrest 4 can be effected independently of each other.

That is, in the chair-type massage apparatus 1 of the third embodiment, no linking mechanism 28 is disposed between its backrest 3 and footrest 4, and there is provided up-and-down means 15 as a mechanism which is operated independently of the rocking motion of the footrest 4 relative to a base frame 8. Moreover, the chair-type massage apparatus 1 of the third embodiment is so designed that its seat 2 moves back and forth in synchronization with the up-and-down movement of the backrest 3. Also in respect of the movement of the seat 2, the third embodiment differs from the first and second embodiments.

More specifically, the chair-type massage apparatus 1 of the third embodiment has the seat 2 which is free to move in the front-rear direction relative to an upper frame 10 of the base frame 8. Between the seat 2 and the upper frame 10 is disposed a slide section 45 for supporting the seat 2 in a manner such that the seat 2 is guided in free movement in the front-rear direction relative to the upper frame 10. In addition, between the seat 2 and the upper frame 10 is disposed a link driving section 17 for moving the seat 2 supported by the above-described slide section 45 in a manner such that the seat 2 switches freely between a front position and a rear position relative to the upper frame 10.

The link driving section 17 is a long member for producing power to rock the backrest 3 and the footrest 4 relative to the base frame 8. In the third embodiment, an electric linear actuator is used for the link driving section 17, wherein a mobile element 18 formed on the front-end side travels longitudinally (moves closer to and away from the basal end) under a torque produced by an electric motor.

The basal end of the link driving section 17 is secured to the front side of the upper frame 10, and the mobile element 18 of the link driving section 17 is attached to the rear end of the seat 2. That is, by driving the link driving section 17 so that the mobile element 18 can move closer to and away from the basal end, it is possible to move the seat 2 back and forth relative to the base frame 8.

Moreover, in the chair-type massage apparatus 1 of the third embodiment, between a lower frame 11 of the base frame 8 and the lower end of the backrest 3, there is provided a substantially rectilinear up-and-down link member 16 for coupling the lower end of the backrest 3 to the base frame 8 for free rocking motion about the right-left axis.

One end (front end) of the up-and-down link member 16 of the third embodiment is coupled directly to the lower frame 11 (not coupled through the projection 22 to the lower frame 11). As compared with the up-and-down link member of the first and second embodiments, the up-and-down link member 16 is coupled to a lower position of the base frame 8 in the vertical direction. On the other hand, the other end (rear end) of the up-and-down link member 16 is coupled to the lower end of the backrest 3 for free rocking motion about the right-left axis. Thus, the backrest 3 can be moved up and down by the rocking motion of the up-and-down link member 16.

Moreover, the lengthwise midpoint of the up-and-down link member 16 and the bottom surface of the seat 2 are coupled to each other by an interlocking arm member 46. The interlocking arm member 46, being mounted for free rocking motion relative to the seat 2 and the up-and-down link member 16 as well, is capable of rocking the up-and-down link member 16 in synchronization with the back-and-forth movement of the seat 2.

Figure 13A:
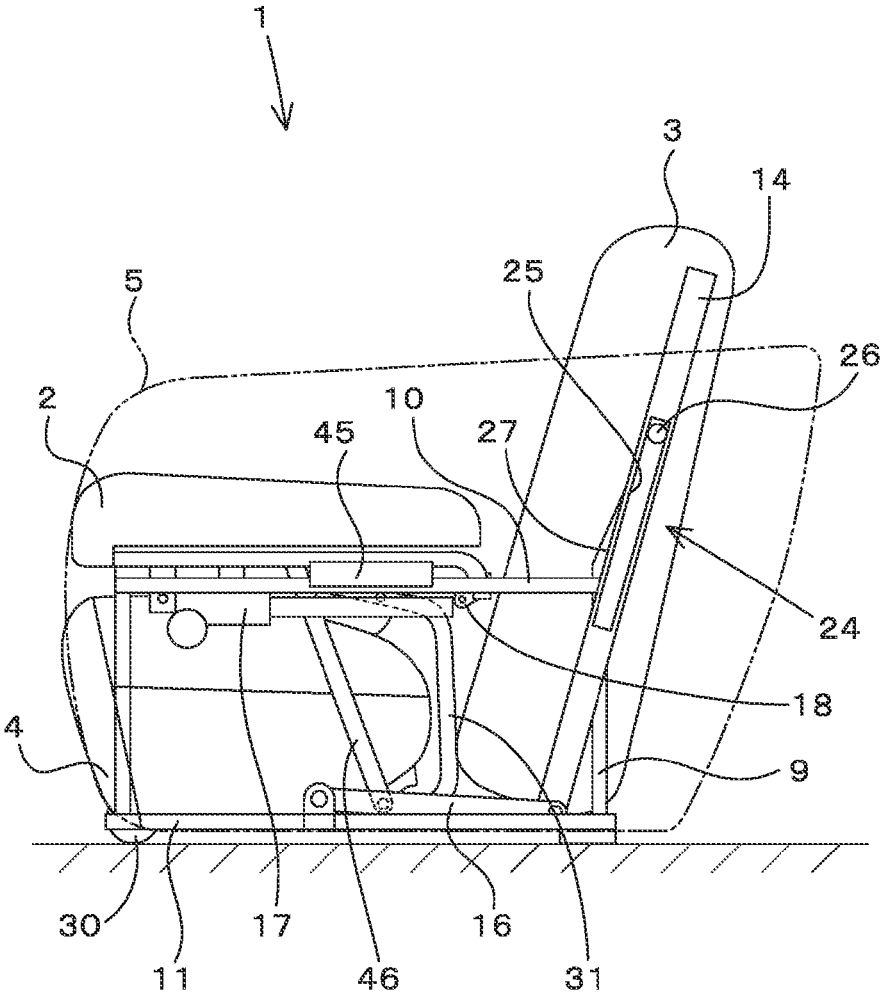
FIG. 13A is a side view showing the internal structure of the apparatus, with the backrest held in the housing position.
Figure 13B:
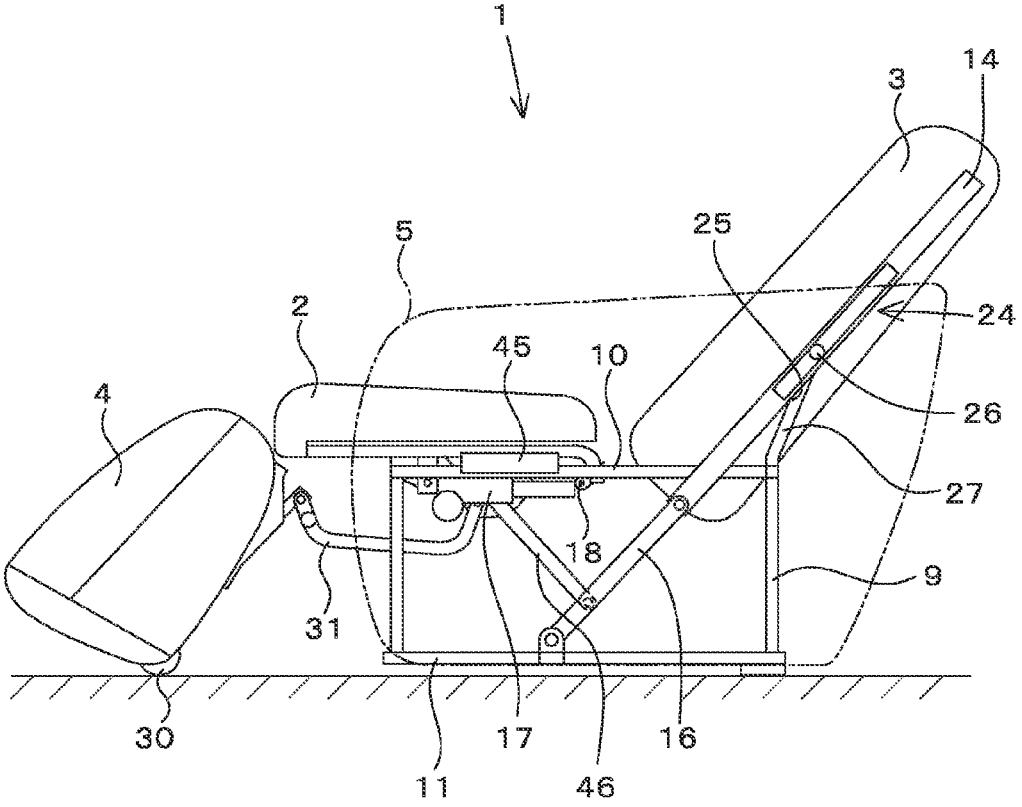
FIG. 13B is a side view showing the internal structure of the apparatus, with the backrest assuming the protruding position (Third embodiment).

That is, in the chair-type massage apparatus 1 of the third embodiment as shown in FIG. 13A, by driving the above-described electric actuator to telescope (so that the mobile element 18 moves toward the basal end), the seat 2 is moved forward relative to the base frame 8. In response to the forward movement of the seat 2, the up-and-down link member 16 coupled through the interlocking arm member 46 to the seat 2 is rocked at the other end in the counterclockwise direction as viewed in FIGS. 13A and 13B on one end as a pivot. In this way, as the other end of the up-and-down link member 16 is rocked on one end as a pivot, the backrest 3 coupled to the other end of the up-and-down link member 16 is moved upward correspondingly. Then, as shown in FIG. 13B, the backrest 3 is moved from the massaging position to the first protruding position, and from there to the second protruding position. On the other hand, the lowering of the backrest 3 can be effected by reversing the procedure thus far described.

Meanwhile, as is the case with the first and second embodiments, the chair-type massage apparatus 1 of the third embodiment is also provided with a footrest rocking link member 31 for moving (rocking) the footrest 4 back and forth. The footrest rocking link member 31 of the third embodiment has its basal end pivotally supported on the bottom surface of the seat 2 for free rotation about the right-left axis, and has its front end pivotally supported on the upper part of the footrest 4 for free rotation about the right-left axis.

The footrest rocking link member 31 is designed to be driven by a separate electric linear actuator (not represented graphically) than that used for the link driving section 17. Alternatively, the footrest rocking link member 31 may be designed to be rocked back and forth by the operation of a manual lever, for causing the footrest 4 to advance from a housing position to a working position and contrariwise causing the footrest 4 to retract from the working position to the housing position.

That is, in the chair-type massage apparatus 1 of the third embodiment, the footrest 4 can be moved back and forth regardless of the condition of the backrest 3. Accordingly, the rising and lowering of the backrest 3 using the up-and-down means 15 and the putting in and out of the footrest 4 can be effected independently of each other. This makes it possible to change the postural condition of the chair-type massage apparatus 1 freely to meet user's needs, and thus improve the convenience of the chair-type massage apparatus 1 even further.

Otherwise, the third embodiment thus far described is substantially the same as the second embodiment in respect of structure, working condition, functioning effect, and so forth, and therefore the components that play the same or corresponding roles as in the second embodiment will be identified with the same reference symbols in the drawings, and the detailed description thereof will be omitted herein.

It should be understood that the embodiments as set forth hereinabove are considered in all respects as illustrative only and not restrictive. Especially particulars that are not stated explicitly in the disclosed embodiments, for example, service conditions, operational procedures, various parameters, and the dimensions, weights, volumes, and so forth of constituent components will not depart from the scope of practice customarily made by those skilled in the art, and the aforestated particulars take on values that can easily presumed by those having ordinary skill in the art.

The invention claimed is:

1. A chair-type massage apparatus comprising:

a seat;

a base frame for supporting the seat on a floor;

a backrest disposed at a rear of said seat for support of user's back; and a massage section incorporated in said backrest, for performing a massage on a user sitting on the seat, wherein there is further provided up-and-down means for switchably changing a height of said backrest in a vertical direction within a range between a housing position where a lower part of said backrest is stored under the seat and a protruding position where the lower part of said backrest is raised to be located above the housing position, wherein said protruding position involves a first protruding position where said backrest is in an upwardly-extending state and a second protruding position where said backrest, while assuming the first protruding position, is tilted backward into a reclined condition, and wherein said up-and-down means is designed to move said backrest in the vertical direction between the housing position and the first protruding position, as well as to move said backrest in a front-rear direction between the first protruding position and the second protruding position.

2. The chair-type massage apparatus according to claim 1, wherein said up-and-down means comprises:

an up-and-down link member which has its one end coupled to said base frame for free rocking motion about a right-left axis, and has its other end coupled to a lower end of the backrest; and a link driving section which is coupled at its basal end to said base frame, and has a mobile element formed at a front end thereof so as to be coupled to a midpoint of said up-and-down link member, for rocking said up-and-down link member about a right-left axis by moving a front end-side mobile element closer to and away from the basal end.

3. The chair-type massage apparatus according to claim 2, wherein said up-and-down link member is built by joining a first member, which is coupled to said base frame for free rocking motion about a right-left axis, and a second member coupled to said backrest for free rocking motion about a right-left axis together in substantially L shape, and wherein said second member is so disposed that it becomes substantially parallel with the floor when said backrest is held in the housing position.

4. The chair-type massage apparatus according to claim 3, wherein, under said seat is stored a footrest for massaging the lower legs of a user, wherein, between said footrest and the base frame is disposed a footrest rocking link member for coupling the footrest to said base frame for free rocking motion about a right-left axis, and wherein, between said up-and-down link member and the footrest rocking link member is disposed a linking mechanism for rocking the footrest rocking link member in response to the rocking motion of the up-and-down link member.

5. The chair-type massage apparatus according to claim 4, wherein said linking mechanism includes a rocking amount adjustment member for adjusting the amount of rocking motion of the up-and-down link member for moving said backrest so that it changes to the amount of rocking motion of the footrest rocking link member for moving said footrest, and whereafter transmitting that rocking amount.

6. The chair-type massage apparatus according to claim 2, wherein said backrest has formed at its side surface a long guide slot extending along the direction of the length of the backrest, wherein said base frame is formed with a backrest support frame for supporting said backrest, and wherein said backrest support frame has formed at its front end a position-holding section which is slidably fitted in the guide slot of said backrest for holding the position of said backrest during its up-and-down movement.

7. The chair-type massage apparatus according to claim 1, wherein an armrest is mounted on each of the right side and the left side of said seat, and wherein an upper end of said backrest is located at substantially the same level as an upper surface of the armrest when the backrest is held in the housing position.

* * * * *